US008752353B2

(12) United States Patent
Zinser

(10) Patent No.: US 8,752,353 B2
(45) Date of Patent: Jun. 17, 2014

(54) STACKABLE SURFACE MODULE FOR A WALL SURFACE

(75) Inventor: Klaus Zinser, Bad Schussenried (DE)

(73) Assignee: Klaus Zinser, Bad Schussenried (DE)

( * ) Notice: Subject to any disclaimer, the term of this patent is extended or adjusted under 35 U.S.C. 154(b) by 0 days.

(21) Appl. No.: 14/002,303

(22) PCT Filed: May 30, 2012

(86) PCT No.: PCT/DE2012/000574

§ 371 (c)(1),
(2), (4) Date: Aug. 29, 2013

(87) PCT Pub. No.: WO2012/163336

PCT Pub. Date: Dec. 6, 2012

(65) Prior Publication Data

US 2013/0333319 A1 Dec. 19, 2013

(30) Foreign Application Priority Data

May 30, 2011 (DE) ..... 10 2011 050 725

(51) Int. Cl.
*E04B 2/00* (2006.01)
*E04C 3/00* (2006.01)

(52) U.S. Cl.
USPC ..... 52/588.1; 52/578; 52/561; 52/574; 52/575

(58) Field of Classification Search
USPC ..... 52/588.1, 578, 561, 569, 574, 575
See application file for complete search history.

(56) References Cited

U.S. PATENT DOCUMENTS

| | | | |
|---|---|---|---|
| 5,888,612 | A | 3/1999 | Needham et al. |
| 6,679,022 | B1 | 1/2004 | Corporaal |

FOREIGN PATENT DOCUMENTS

| | | | |
|---|---|---|---|
| DE | 971 377 | B | 1/1959 |
| DE | 2 042 131 | B | 12/1972 |
| DE | 7 403 455 | U | 5/1974 |
| DE | 2 911 261 | A1 | 1/1981 |
| DE | 3 622 258 | A1 | 1/1988 |
| DE | 9 300 686 | U1 | 4/1993 |
| DE | 19 934 264 | A1 | 3/2001 |
| FR | 557 828 | A | 8/1923 |
| FR | 2 367 161 | A1 | 10/1976 |
| FR | 2 422 780 | A1 | 12/1978 |
| FR | 2 653 800 | A1 | 10/1989 |
| WO | 81 02 983 | A1 | 10/1981 |
| WO | 01/20092 | A1 | 3/2001 |

OTHER PUBLICATIONS

International Search Report of corresponding German Application No. PCT/DE2012/000574, Oct. 16, 2012.
Examination Report of the corresponding (granted) German patent application No. DE 10 2011 050 725.6, Nov. 4, 2010.
Examination Report of the corresponding (granted) German patent application No. DE 10 2011 050 725.6, Dec. 12, 2011.

*Primary Examiner* — Mark Wendell
(74) *Attorney, Agent, or Firm* — Global IP Counselors, LLP

(57) ABSTRACT

A stackable surface module is provided for a wall surface that can be both erected and dismantled. The stackable surface module is especially useful in certain applications, such as for earthquake-resistant walls, a cupola, a bridge, a site fence, a noise protection wall, an upwind power station, a heat exchanger or a coastal protection wall.

15 Claims, 2 Drawing Sheets

STACKABLE SURFACE MODULE FOR A WALL SURFACE

CROSS-REFERENCE TO RELATED APPLICATIONS

This application is a U.S. National stage application of International Application No. PCT/DE2012/000574, filed May 30, 2012.

BACKGROUND OF THE INVENTION

1. Field of the Invention

The invention relates to a stackable surface module for a wall surface that can be erected and dismantled (reversible) and the use of the surface module for particular applications, especially for earthquake-resistant walls, a bridge, a compost shed, a site fence and noise-protection wall, an upwind power plant, heat exchangers or a coastal protection wall—also for walls of buildings.

2. Background Information

To erect such a wall or similar edifice, it is well known that individual building blocks or wall modules are to be laid one on another and joined together with a substance which hardens out, e.g. mortar. In this, a building block is to be so laid on two adjacent building blocks that it covers half of each of the two blocks. This results in strong masonry, but with the disadvantage that the wall can no longer be altered and can only absorb forces to a limited extent, especially bending moments and buckling.

In certain applications, the wall elements can withstand pressure or bending loads, e.g. perpendicular to the wall surface. With torsion loads in the horizontal direction in the wall surface, these modular units should be able to absorb and distribute or dissipate these without breaking; severe local bending, also in the vertical axis, and the resulting falling out of individual building blocks are to be avoided.

A further problem is that, in the case of a joint, e.g. with glue or mortar, the weakness of each individual module element determines the overall properties of the complete wall area—so that no stabilizing synergies develop. Walls with state-of-the-art technology require a greater thickness and width in order to maximize the surface for the jointing material and ensure high adhesion.

Up to now, there have hardly been wall modules that are able to absorb torsional/buckling stresses without loss of integrity. The aim is therefore to provide a surface module that allows the reversible erection of a wall area preferably with a single module element. In the normal case, it shall not be possible to remove elements on both sides (left/right and front/rear) from the erected wall without removing the topmost level. The wall area should also make it possible to construct high walls with at the same time higher bending stability and pressure absorption in the transverse and longitudinal directions to the wall, especially forces acting normal or horizontally to the wall.

It shall be possible to combine the surface modules without additional substances, e.g. mortar or other adhesive elements, into a wall surface that is stably interlocked—although the use of such substances should not to be excluded.

The current state of the technology describes such surface modules in FR 2 653 800. Such a module is shown in FIG. 1. However, these extremely thick-walled modules are stacked in rotation and are not interlocked sideways with each other. The lower recess also does not serve as a seating for the left and right side extensions; but of the upper bulge instead. The lengths b2 and b1 of these extensions are not identical and do not correspond to the length 1B. This module is therefore unsuitable for the present method of stacking to be achieved with the clamping effect as described in the following.

The H-modules in DE7403455 have no interlocking points which explain their enormous thickness in comparison with the height. The same applies to the U-shape in DE 29 11 261.

Construction elements for all wall surfaces with recesses are also known from the French publications FR 2 367 161 and FR 557 828. In these, wall modules with large wall thicknesses are presented. These modules also possess recesses (H-shape) and also, in part, interlocking points in order to couple up with neighboring modules (see Design 1. FIG. 1). However, the modules have disadvantages. The modules are generically thick in relation to their other dimensions and therefore unsuitable for high, thin walls (see Design 5, bottom right). An interlocking groove running around the entire perimeter wastes material and is difficult to manufacture.

The task of this invention is therefore to present a wall module that is basically suitable for high, thin walls. The module should make it possible to flexibly construct a large number of wall areas; both with completely closed surfaces and those with holes. A special feature of the wall modules should be the ability to resist falling off to the side, despite low wall thickness, and be able to resist bending loads.

In addition, it shall not be possible for the wall modules to move sideways relative to each other. It is necessary, especially in terms of earthquake safety, to suppress sideways shear forces or to direct these to specially predetermined interfaces. The wall area should therefore be secured not only against shifting in the direction of falling but also in the sideways direction.

These tasks are solved using a stackable surface module with the following properties.

The terms x-, y- and z-directions correspond to the directions along the relevant axis directions in an orthogonal, Cartesian coordinate system. The surface modules are aligned corresponding to their alignment in the wall surface. The z-axis direction is the stacking direction of the modules, which is usually upwards, against the force of gravity. The x-axis direction corresponds to the longitudinal axis of the wall surface and the y-axis is in the direction of the wall thickness.

In a first aspect, the invention therefore concerns a surface module corresponding to the following description:

Stackable surface module for the reversible construction and dismantling of a wall or shell surface, wherein the surface module possesses a three-dimensional form and extends in the x-, y-and z-directions, and a multitude of these surface modules can be stacked in the z-direction, and the front and rear sides of the surface module each point in the y-direction, the top and bottom sides each point in the z-direction and the lateral sides point in the x-direction, and the side projection area of the front side or rear side onto the x/z-plane is greater in each case than the side projection area of the top or bottom side onto the x/y-plane and the side projection area of the front side or rear side onto x/z-plane is greater than the side projection area of the lateral sides onto the y/z-plane and a multitude of these surface modules can be fitted together so that, in the interlocked state, they can form a contiguous wall or shell surface from these surface modules, which extends continuously in the x- and z-directions, and wherein a multitude of said modules, in the z-stacking direction, each offset in the x-direction and rotated relative to each other by 180° about the x-axis and/or y-axis, can be stacked in the z-direction, wherein the surface module includes at least two lower extensions in the z-direction and at least one lower recess pointing upwards in the z-direction which is confined in the x-direction by the said extensions and lying between the extensions, wherein the surface module also includes interlocking points overlaid on the basic surfaces of the module perimeter, which are interrupted at least at one point along the entire module perimeter, wherein an interlocking point can block the movement of neighboring modules in the wall in one of the two y-directions, wherein the module includes at least one interlocking point pair with positive and negative interlocking points, wherein the positive interlocking points can block the positive y-direction and the negative interlocking points can block in the negative y-direction so that an interlocking point pair can block in both y-directions in the wall.

The general advantage of the invention is in the construction of especially thin, toppling-resistant walls made from surface modules. In the current state-of-the-art, quite thick blocks are used in comparison with the said surface modules. The use of further layers allows an increase in the module thickness in the y-direction, which raises material costs without bringing any additional stabilization effect. With the present thin construction, the y-axis locking in both directions normal to the wall area, can be achieved with a lower wall thickness. This can offer decisive advantages, e.g. in the building of sloping or overhanging walls, for example in the building of cupolas or other building designs with special earthquake-proof qualities.

The basic surfaces of the module are generally present independently of the interlocking points. The additional upwards and downwards-projecting protuberances or hollows of the courses at the interlocking points are overlaid onto the basic surfaces and therefore form additional interlocking surfaces in the x/y-plane and intermediate surfaces in the x/z-plane. The other arrangements of the basic surfaces remain unaffected.

A locking in both y-directions normal to the wall or shell surface means that the particular joined modules at these points in the assembled condition allow no relative movement in the y-direction, with the exception for a small optional amount of play.

This means that bending moments can be transferred to the modules. At the interlocking points, forces can be transferred or dissipated. This means that the wall surfaces made available can absorb bending forces and distribute these over the wall surface. This is important with earthquakes but also for high walls exposed to wind forces or vibrations (updraft power plants). Rigid connections using mortar regularly threaten to break or a form cracks. On the other hand, the wall modules must be secured against permanent shifts or the breaking out of individual modules from the wall. In this case, the interlocking points lock the movement in the y-direction, while the basic forms of the surface module prevent movements in the masonry in the x-direction.

The basic surfaces of the module perimeter are the basic surfaces of the upper side, underside as well as the left and right lateral surfaces. These are therefore located between the front side and the rear side of the surface module. These surfaces form a perimeter around the said module.

An interruption in the interlocking point or points along the module perimeter means that the modulation of the upper, lower or side basic surfaces for the generation of the interlocking point is not continuous along the entire module perimeter. Because of the interruption, at least at one point along the module perimeter a surface is generated that is continuously parallel to the y-axis.

This has several advantages. It is essential that the module in both y-directions is protected against falling over. However, it is not desirable to use more material than really necessary. The effort required to prepare the interlocking points should be minimized. The interlocking points should therefore not run along the entire perimeter. It is preferred that the surface module defines positions for the interlocking points along the perimeter. This saves material and leaves the option open to supply special reinforcement to these areas. The interlocking points can be defined as force application points with special stability.

This interruption can also increase the stability against movements in the x-direction or distribute the deflection of the modules via defined force application points, which can be valuable in earthquake applications.

This design has also the advantage that the entire wall area can have holes at certain points. If the module is interlocked along the entire perimeter, the modules then interlock circumferentially with each other and holes through which one could look in the y-direction or serve as cable guidance and other module supports or articulation points at the corners could be excluded.

Ultimately, complete interlocking allows less flexibility in the variation of the surface shapes and wall thicknesses. Curves in the modules are much more difficult to realize when the interlocking points are over the full thickness and the modules are more difficult to join together than when the interlocks have only to be brought together at several predefined points. Such curves in one or even two axis directions are indispensable for the construction of domes using module elements.

The present solution makes assembling easy with unlimited material length of the interlock points. With three interlocking pairs at various positions along the perimeter, bending moments can still be absorbed in all directions. It is also possible, although not mandatory, to have hole positions in the wall when the surface of the wall is not to be completely filled. Should an interlocking point extend uninterrupted along the entire external module perimeter, the wall surface could not then have any holes in the y-direction (front side to rear side).

The interlocking point pair locks in both y-directions and therefore allows no movement of the neighboring modules in the y-direction.

A wall surface can be formed by the stacking of the modules. This wall surface has the advantage that it requires only one type of surface module to construct a closed wall surface. In contrast to a jigsaw puzzle, all parts can be largely the same shape.

The wall also experiences a greater lateral stability due to the greater interlocking of the module surfaces which leads to better frictional forces between the modules caused by the greater surface per unit volume of the form compared with a regular solid or cube of a commercially available brick. This allows thinner walls to be built, which is especially important for some applications. Preferred are wall thicknesses from 2 to 25 cm; even up to 100 cm are also possible: this also saves material and the wall is lighter for its height, i.e. the weight per unit area in kg/m2 is lower.

To prevent shifting of the modules against each other in the x-direction, interlocking joints and, to some extent friction locking joints, are used. This is counter to previous methods in which stones were joined using mortar or adhesive (cohesion and adhesion) in the erection of a wall or building or the formwork for walls and beams (reinforced steel). The central element of the present invention is the ability to dismantle and re-use the modules or a prefabrication and erection on-site as the necessary transportation would be uneconomic or impossible.

To erect the wall, the modules are laid in a course in the x-direction next to each other. To lay the next course of modules, the modules in the courses above and below that one are rotated alternately by 180° and offset in the x-direction and stacked one above the other. Preferred here is that the next course of modules in the z-direction is offset by up to a half-module length. With surface modules that have no symmetry plane in the y/z-plane, other alternating offset distances in the x-direction are possible, e.g. typically one third/two thirds and so on. The modules are typically laid on from above.

The entire internal surface of a recess can be preferably covered by the surfaces of the extensions. In the resulting stacked wall surface, the opposed mating surfaces are complementary to each other so that they can be put together as an exact fit. Preferred is that these extensions completely fill the recess.

Preferred is that the surface module is characterized by that at least two extensions from adjacent modules in the wall surface course can be inserted in the same module recess from the wall courses lying above and/or below in the z-direction.

The extensions of neighboring surface modules in a course of the wall surface are therefore held together by the clamping effect of the recess of the surface modules of the horizontal courses immediately above or below it in the wall surface and so anchored that they can withstand tensile stress in the x-direction. The surface modules are preferably positive form-fit connected to prevent being pulled out in the x-direction. The preference here is for a single module type. With that, a complete wall can be built from a single module that is stable against sideways tensile or compression loads as well as bending stress. Additional connecting material such as mortar or adhesive is therefore, in principle, not necessary.

Lateral surfaces are generally parallel to the z-axis; they can however form an angle of up to 45° with the said axis. Lateral surfaces mostly run parallel to the y/z-plane and at right angles to the x-axis. An angle of more than 0° to the y-direction has the effect that the shape of the module in this direction is no longer continuous, which is a central theme of interlocking points. Horizontal surfaces are generally parallel to the x-direction, can however form an angle of less than 45° to this axis; they are typically parallel to the x/y-plane and at right angles to the z-direction, except at the interlocking points.

The front, rear, under, top, and lateral sides of the module correspond to the surfaces that are visible from the corresponding main axis direction. The front and rear sides correspond here preferably to a single planar surface but it is possible that, e.g. the lateral sides or the underside or topside can be formed from several surfaces or that the surfaces form a non-planar curve. A surface is defined in each case at the boundaries by the external edges. An edge is produced by a non-continuous curve of the derivative along the surface, e.g. along the x-axis.

The modules are stackable if they can be so set one on top of the other that several of these modules can form a wall surface that extends both in the z- and x-directions.

It is a special feature of the invention that the wall surface constructed is preferably higher in the z-direction than the thickness of the wall surface in the y-direction. In this, modules are preferably set that are higher in the z-direction than thicker in the y-direct; preferably twice as large.

The greatest extent of the module in the x-direction is also typically greater than the greatest extent in the z-direction; preferably twice as large.

The invention also includes a stackable module in which the overall module thickness varies in the z-direction.

This can be achieved by the use of module elements with different thicknesses of wall or, alternatively, for unitary surface modules by a variable extension upwards in the z-direction. It is a special characteristic of the invention that these modules with different thicknesses nevertheless fit together as the shapes are complementary. In preferred variants, the wall becomes thinner with increasing height.

The modules can in each case be inserted only from above as a preference. Undercuts of shape in the z-direction are generally excluded, unless spacer disks are used.

Preferably, several modules of this type are fitted together so that these, in an assembled state, can be added in the x-and z-directions to form the continuous wall surface.

A continuous, contiguous wall surface is obtained when the wall surface can be extended as desired and when the wall modules are connected together (reversibly detachable) in each case.

In the assembled state, complementary surfaces of the modules are in opposition to each other. These complementary surfaces show preferably at least one line of contact. The points of contact in the complementary surfaces may contain gaps.

In preference, the wall surface in the assembled state has gaps between the modules whose diameters in the x- or z-direction are smaller than 1/5 of the maximum extent of a module in the x-direction; the gap is preferably smaller than 1/10 of the maximum extent of the module in the x-direction.

Smaller gaps in the form may exist to leave room for further elements in the wall surface, so that the latter can, e.g. still include pipes, bolts or steel beams or cable/pipe tracts (e.g. electric cables or water pipes) can be allowed for.

Although the modules can form a wall surface with no gaps, it is often intended to interrupt the wall surface by building in windows or similar elements. Complete modules made from transparent material can take over similar functions.

It is preferred that the modules fit together completely flush with one another in the x- and/or z-directions, i.e. there are only small gaps whose diameters in the x- or z-directions are less than 1/50 of the maximum x-dimension of a module, preferably less than 1/100 of the maximum x-dimension of the module. In this case, the joint between the modules is an exact fit.

When the modules are assembled, the relevant complementary surfaces make contact at least at three points. This ensures that the surfaces are stably mounted relative to each other.

Gaps are also conceivable when thin contact lines or contact edges are used instead of lateral contact surfaces. The easy transfer of forces between the module surfaces should be possible without generating too high local compression forces.

The wall surface consists preferably of a surface module form; in special variants of the invention it can be preferable to fit intermediate modules, spacers, plates, wedges or other similar modules.

To produce a complete, finished wall with straight side surfaces, it is necessary to attach end pieces to the boundaries of the wall surface, e.g. at the top or bottom side.

In special further developments of the invention, additional smaller, intermediate pieces that are inserted between the planar modules can be used to construct the wall surface. For example, an additional plate module element can increase the stress between the modules. If a module element is inserted between the extensions in a recess, the clamping effect can be increased additionally. It is preferable that the insertion takes place without using any force.

In the simplest case, the surface module has a cubic or rectangular form with a cut-out. Forms only, or almost only, with right angles are preferred.

A side projection area is the area of a projection on to one side of a plane formed by the two main axes. This corresponds to the section of the module in the direction of the main axis. The overall area shadows formed by this onto the particular plane can be compared in terms of their area. Typically, the projection area of the front and rear sides is greater than the projection area of the upper and lower sides; preferably greater by a factor 2. The former are however preferably larger than the lateral side areas—preferably by a factor of 10. The maximum dimension of the planar module in the x-direction is preferably larger than the maximum dimension in the z-direction. The module in the wall is therefore wider than it is high. The wall is also preferably thinner than it is high or wide. Especially thin walls can be built using this invention—so saving material.

In a preferred implementation of the invention, the projection area of each section plane of the module in the x/z-plane is not the same area as in the front projection. The recesses in the y-direction are not then continuous and there may be undercuts in the y-direction.

A summary of the designations of the basic surfaces of the module is presented just before the descriptions of the figures.

In the following, the basic forms of the module, especially in the x/z planes, are shown.

In principle, the module has at least two lower extensions that are extended further in the z-direction than a lower recess lying in the x-direction between the said extensions.

An extension in a certain direction is a protruding module section or volume element of the module that extends further in a certain direction than neighboring volume elements.

An extension upwards or downwards in the z-direction means that the upper/lower extensions (sections of the module) protrude further out than the section of the module lying between these extensions, which itself represents a recess. The extensions are also typically the extensions of the module section in the z-direction that protrude farthest downwards and upwards.

The preferred locations of the extensions are at the lower left and right sides of the module (left and right legs), that are connected by a central higher intermediate part of the module.

Preferred is that with regard to the overall module the, at least two, lower extensions are extended furthest in the z-direction. In this simplest variant, this corresponds to an inverted, angular "U" in the front side profile, i.e. a U-shape. In this case, two neighboring module courses can each be protected in the wall surface against pulling apart in the x-direction. In the simplest arrangement, the surface of the U-shape is flat and level so that no interlocks take effect between the course pairs and the wall surface is not protected throughout against tensile loads in the x-direction. The basic surface of the module therefore preferably has further elements, as described below.

It is preferred that each of the lower extensions has an underside surface. These lower side surfaces of the extensions should however be complementary in every case to the (upper) superior inner surface of the corresponding recess. These surfaces lie next to each other in the wall surface and it should therefore be preferably possible to fit these together precisely without any gaps. In a similar way, this applies also to any upper extensions and the corresponding (lower) inferior inner surfaces of an upper recess.

Preferably, the underside surface of extensions runs parallel to the x/y-plane or to the y-direction and/or to the x-direction. A horizontal level surface is therefore preferred. In this case, the underside surfaces of the extensions lie horizontally on the inner surfaces of the corresponding recesses and in an erected wall the gravity force vector is, in the ideal case, normal (at 90°) to the surfaces. The opposing surface on the inner side of the corresponding recess must therefore also be parallel to the x/y-planes, i.e. preferably run horizontally and flat.

The extension is to be preferably limited by the following limiting surfaces: the lateral inner side(s) of a recess, then in clockwise or counterclockwise direction the undersides of the extension itself, then at least one section of a lateral outer side of the module and finally a theoretical continuation in the x-direction of the highest point (preferably horizontal) of the superior inner surface of the recess. The extension is connected via the theoretical line with the main body of the module.

The lengths of the extensions in the z-direction vary depending on the application. For concrete or stone structures, the extensions are preferably between 0.5 cm and 2 m long in the z-direction, more preferably between 1 cm and 50 cm, even more preferably between 2 cm and 20 cm. In applications using wood or plastics, the preferred dimensions are approximately half of those above. The width of the extensions in the x-direction is preferably of the same order as the length.

The overall module length in the x-direction is preferably between 4 cm and 10 m, more preferable between 8 cm and 2 m, the greatest preference between 10 cm and 100 cm.

The overall module height in the z-direction is preferably between 2 cm and 5 m, more preferable between 5 cm and 90 cm, even more preferable between 20 cm and 80 cm, with the greatest preference being between 62.5 cm and 75 cm. With a story height of 2.5 to 3 m, and 4 array module courses per story, a surface module would be 62.5 cm to 75 cm in height.

The depth of the module in the y-direction is preferably between 1 cm and 1 m, more preferable between 2 cm and 50 cm and even more preferable between 3 cm and 20 cm.

The module lengths can preferably be reduced or increased by a factor of 0.1 to 10, preferably increased by 1.5 or reduced by 0.75, shortened or lengthened by double the length if necessary. Plastic or wood modules are generally thinner than masonry modules.

The counterparts to the extensions are the recesses.

The highest point of the recess in the z-direction is preferably higher than the lowest points of the extensions which define this recess.

The extent of the recess in the x-direction is preferably confined by the extensions in the z-direction and reaches as far as the lowest points of this recess formed by the extensions.

The extent of the recess is also preferably limited in the z-direction by the extensions and ranges from the highest point of the recess to the lowest point of the extensions which form this recess.

With modules which have a symmetry plane in the y/z-plane, each point of the recess in the z-direction will be higher than the relevant lowest point of the extensions forming this recess.

These cavities of the module are manifested by an interruption in the underside surface (or topside surface) of the module. Preferred is a lower or upper recess directed upwards or downwards to a cavity that is oriented to be open upwards or downwards. A recess is therefore a recessed section of the module in which module surfaces at this point run inwards to form a cavity.

The module has preferably two lower extensions and one lower recess. The module is thereby characterized by the fact that the lower and/or upper recess at its boundaries is characterized by an interruption/edge, i.e. a discontinuous derivative of the curve of each lower and/or upper side surface in the x-direction. The underside or upper side of the module is therefore generally interrupted in the x-direction in order to produce the recess. This results in two flanking sections which form the extensions and a recess lying between them with preferably at least three inner surfaces. The recess is preferably continuous in the y-direction. In such a case, the extensions of the surfaces are not directly connected with each other.

The depth of the recess therefore simultaneously determines the length of the corresponding extension.

The depth of the recess lies preferably between 25% and 75% of the overall height of the module in the z-direction.

The recess depth is preferably more than 30%; even more preferable is between 40% and 60% of the total height of the module in the z-direction.

A greater recess depth relative to the module overall dimensions produces a more powerful clamping effect against being pulled apart and better transfer of a bending moment. In addition, the greater perimeter surface increases the friction force between the modules so giving a better lateral stability against toppling, even at lower wall thickness.

It is also preferred that the maximum module thickness in the y-direction is less than the maximum depth of the recess or of a recess.

An aim of the invention is to provide especially stable, but at the same time thin, walls. With a greater recess depth, it is not only the lateral stability in the x-direction that increases due to the friction interlocking of the module—the increasing perimeter surface provides better friction locking against toppling in the y-direction. This advantage can be improved considerably when there are interlocking points at various positions along the z-direction. The greater the spacing of the interlocking points in the z-direction, the easier it is to absorb bending moments. A greater depth of the recess is therefore advantageous, especially in avoiding toppling of thin walls in the y-direction. This means that thinner wall surfaces can be erected.

The depth of the recess in the z-direction should preferably be half of the total height of the module. The superior inner surface (SI) ("superior", Latin for upper) or inferior inner surface then lies exactly at half the height in the z-direction.

Greater recess depths are possible; the deeper the recess is, the easier it is for the neighboring modules to interlock with each other. However, the depth should not be so great that the upper module section becomes so thin that the material stability is no longer guaranteed and the module becomes too fragile.

In a further implementation, with upper and lower recesses (H-shape) or bulges (these will be described later), the recess depth does not usually exceed half the module height. It is however possible, by the use of additional steps in the inner surfaces of the module (with a lower recess and in addition on upper bulge) to achieve even greater recess depths. A recess depth between 51% and 75% of the overall height in the z-direction is then preferred. With that, the tensile load stability in the x-direction is improved even more and the sliding apart of the modules is prevented. The upper side corners of recess can be made smaller, the example, by the use of an additional step in the recess and so prevent thinning out of the material at this point in the module. If necessary, the module can be given a greater wall thickness at the weak points.

Preferred is that the lower outer surface of the extension (UAE) at the edge of the recess with the lateral inner surface of the recess (LI) forms an angle of 90° to 130°, more preferably between 100° and 90°, the most preferred is an angle of 90°. The angle should generally not be less than 90° (because of the undercuts in the z-direction), otherwise the modules can no longer be stacked on each other in the z-direction without the help of aids such as spacer plates. The angles in this case are to be so understood that these are measured from the lower outer surface of the extensions, through the extension (i.e. for the right extension in the counter likewise direction) to the inner surface of the recess. With many large angles, the edge becomes flatter in order to completely disappear at 180°—in this case, there is no recess.

A recess has at least one inner surface (I).

Inner surfaces of the module are surfaces that form a recess. They are therefore to be found basically within the outer limits of the module. These surfaces therefore generally always have a further surface or side of the module which lies further out than the inner surfaces in one of the main axis directions. An inner surface typically exists when, for each module inner surface, there exists a further outward-lying surface (i.e. seen from the mid-point of the module in the x/z plane).

Outer surfaces (A) of the module are basically those surfaces of the module that form no recesses in the module.

Should the recess surface be a non-planar curved surface, the module then has a total of at least eight surfaces (but mostly more than this). Starting with a rectangular solid, the underside surfaces are divided into at least three areas by the recess interruptions: one inner surface and the two underside surfaces of the extensions.

With flat inner surfaces, there exist at least two inner surfaces. When there are exactly two surfaces, this leads to a wedge-shaped indentation pointing upwards as a more or less steeply formed notch. In such a case, the angle between the lower extension surface (lower outer surface of the extension (UAE)) and the first inner surface is greater than 90°. The module then has a total of at least 9 surfaces.

At least three inner surfaces are preferred; this means that in modules with only right angles, the recess with three surfaces can be achieved; this results in a right-angled cavity in which appropriate right-angled extensions can be inserted.

Preferably, the three inner surfaces (LI) are formed by two lateral inner surfaces and one upper superior inner surface (SI) running parallel, preferably horizontally, to the x/y-plane (in the case of on upper recess, this is a matching horizontal (lower) inferior inner surface (II)).

It is preferred with the stackable module of this invention that at least one of the recesses is a superior inner surface of the module, which makes an angle of between 60° and 90° with the z-axis and/or that at least one of the recesses has at least two lateral inner surfaces, which form an angle of between 60° and 90° with the x-axis.

The superior inner surfaces are therefore preferably oriented horizontally (at right-angles to z). With an angle of 0° to the z-axis, the superior inner surfaces would be parallel to the z-direction. In the above case, the specification of the angle describes the angle between the superior inner surfaces and the z-axis in both directions, i.e. in the clockwise and counterclockwise directions as seen from the front. Angular specifications of more than 90° are therefore not possible.

Even more preferable are angular ranges of the superior inner surfaces with the z-axis or the lateral inner surface with the x-axis of von 85° to 90° and an even greater preference for 88° to 90°; the greatest preference is for 90°.

The minimum of at least one superior inner surface is typically parallel to the x/y-plane and so is horizontal in the erected wall surface. However, alignments of this upper inner surface are possible which form an angle of 0° to 89° with the x/y-plane.

The superior inner surfaces can also show a variety of characteristics that include non-planar curves or discontinuous derivatives of the curves (edges). The superior inner surface has preferably one or more additional steps or recesses.

The superior inner surface (SI) is generally used as a support for the lower extension surfaces, i.e. the lower outer surface of the extension (UAE). In most of the implementations of the invention, the superior inner surfaces are therefore aligned horizontally with the completed wall surface.

Two or more superior inner surfaces are possible that lie at the same height or different heights or depths.

The module in this invention has preferably two lateral outer surfaces (LA) which form an angle of 60° to 90° with the x-axis.

In this case too, the specification of the angle refers to that between the lateral outer surfaces and the z-axis in both directions, clockwise and counter-clockwise as seen from the front. Specifications of angles greater than 90° are therefore not possible.

A greater preference is an angle of 85° to 90° or from 88° to 90°; the greatest preference is for 90°. These lateral outer surfaces are therefore not always exactly vertical. They are referred to as lateral outer surfaces (LA). At 90°, these lateral outlying surfaces on the module are formed from several modules arranged vertically in the wall surface.

The module has preferably between two and ten lateral outer surfaces.

The lateral outer surfaces of the module are at the same time preferably also the external boundaries at the side of the extensions (LAE). This is especially the case when the module has only one lower and/or upper recess. The extensions therefore form at least two outer surfaces or outer edges of the module, lying as widely as possible from each other in the x-direction, which have mostly an angle of between 60° and 90° with the x-axis. With lower extensions, the lateral outer surfaces of the extensions (LAE) are preferably in the lower section of the lateral outer surface of the module. In certain forms that are implemented, the lateral outer surfaces of the extensions (LAE) then correspond to a part-section of the lateral outer surfaces (LA) of the module.

The stackable module in this invention is preferably fitted out so that at least two of the lateral outer surfaces, which are located on different sides of the module, can be joined together at least partly complementarily and/or with an exact fit. In some cases however, line contact along the mating surfaces can be sufficient.

It is a special characteristic of the invention that the inner surfaces of a recess in the module can be completely covered in each case by the complementary extension surfaces, which are inserted in the recess in order to construct a wall surface. These two extensions are each typically from two different modules in neighboring courses in the z-direction.

This means that the next but one module courses preferably do not touch each other. This leads to better tensile strength in the x-direction (longitudinal axis stability). In the erected wall surface, the gravitational force produces a clamping effect, which holds the module additionally in place. The gravitational force is of special importance in variants where the lateral inner surfaces are not aligned exactly vertical (parallel to z-axis).

A consequence of this is that the lateral outer surfaces of two neighboring modules in a course are joined together when constructing the wall surface. These lateral outer surfaces (LA) which stand the farthest apart in the x-direction (which also form in most cases the outer surfaces of the extensions (LAE)) must therefore, at least in part, i.e. at least at those points in the wall surface that come into contact, be formed as complementary surfaces. The contact sections are generally defined by the lateral outer surfaces of the extensions (LAE). Only when in special constructional shapes of the invention, as described above, the extensions do not completely fill out the matching recess, can it be that points along the extension outer surfaces of the wall surface do not come in contact in the assembled state. Instead, a connection occurs between the lateral outer surfaces of the extension (LAE) and an upper bulge from a module of the next course. These variants will be described later.

These surfaces are generally flat and perpendicular to the x-axis, which means that two parallel outer surfaces are easily joined together. Non-planar or additional steps or recesses in the lateral surfaces lead to opposing surfaces in the wall no longer being equal. In the preferred variants, the lateral surfaces run parallel to the z-axis however in order to guarantee the stackability from above.

Furthermore, the lateral inside surfaces (LI) of the recess are at the same time the lateral inner limiting surfaces of the extensions—the lateral inner side surfaces of the extensions (LIE). These surfaces must be complementary to each other as they can be joined together when rotated in each case by 180° about the x- or y-axis. The surface form and the alignment angle of a right or left lateral inner surface must therefore be complementary to the left or right lateral inner surface that has been rotated by 180° in the other module. In the simplest case, the lateral inner surface of a recess consists of a single lateral inner surface.

There are two basic possibilities here. In the first case, the module for constructing the next course in the wall is rotated by 180° in the y-direction. In this case, the left (LLI) or right (RLI) lateral inner surface of a module comes to lie next to the surface of the next module that has just been rotated. Here, this surface section must be complementary to its own inner surface that has been rotated by 180° about the x-axis.

In the second case, the module is rotated by 180° about the x-axis to construct the next course of the wall. In this case, the left lateral inner surface (LLI) of a module lies next to the right lateral inner surface (RLI). Here, the LLI must be complementary to its own RLI, rotated by 180° about the X-axis, and vice versa.

The lower side surfaces of the extensions are also complementary in each case to the corresponding section (mostly of the one half) of the upper inner surface of the recess, the upper superior inner surface (SI), so that two extensions cover the entire upper inner surface.

Here, there are also two preferential possibilities.

In the first case, the module for constructing the next course of the wall is rotated by 180° about the y-axis. In this case, the lower outer surface of the left extension (UALE) comes to lie next to the left section of the superior inner surface (LSI). These surfaces must therefore be complementary in shape. The length of the lower outer surface of the left extension (UALE) in the x-direction then corresponds to the length of the left section of the superior inner surface (LSI). In the same way, this applies to the lower outer surface of the right extension (UARE).

The second possibility is that the module for constructing the next course of the wall is rotated by 180° about the x-axis. In this case, the lower outer surface of the left extension (UALE) comes to lie next to the right section of the superior inner surface (RSI) and vice versa. These surfaces must therefore be shaped so as to be complementary.

As a whole, the length of the superior inner surface (SI) is the same in both cases (or larger in some cases) as the sum of the lengths of the lower outer surfaces of the extensions (UAE) in the x-direction.

The preference for the module in this invention in a projection on to the x/z-plane of the total surface of two extensions is equal to the total surface of the recess formed between these extensions in the x-direction.

If the front profile of a recess and the complementary extensions are considered, the cavity of the recess is to be preferably so large that it can accommodate both extensions of the module which form the recess.

The total surfaces are typically the same. The extensions of two neighboring modules in a course of the wall then fit flush into the recess of one module fitted above or below in the stacked wall course. This results in a (form-fit) locking against slipping in the x-direction.

It is also possible that a bulging of the module from the next but one course in the wall protrudes into the surface region of a recess of a module in the wall surface. The surface of the recess is then filled by the extensions of the next course and also by the bulge section of the next but one course. This leads to greater canting between the courses and so to a better stability in the x-direction.

The module preferably has an upper surface (OA) which makes an angle with the z-axis of between 60° and 90°.

Also in this case, the angle specification refers to the angle between the z-axis in both rotational directions to the surface as seen from the front (in the opposite direction, the angle is naturally correspondingly greater than 90°).

If a module has upper extensions, the upper outer surfaces are preferably located at the upper outer sides of the upper extensions. More preferable are angular ranges of 85° to 90° referred to the z-axis and a still greater preference for 88° to 90°; the greatest preference is for 90°.

The module in this invention is preferably fitted with at least two lower, outer surfaces that make an angle of between 60° and 90° with the z-axis.

More preferable are angle ranges of 85° to 90° to the z-axis and even more preferable from 88° to 90°; the greatest preference 90°. The lower, outer surfaces are located preferably at the lower sides of the lower extensions.

The module has preferably two or more upper and/or lower outer surfaces; preferably three to twelve, more preferable are four to ten.

It is favorable, when at least two lower, outer surfaces, one from each of two different modules, can fit exactly into the upper surface (superior inner surface) of a recess of a third module.

All outer and inner surfaces of the module can also be represented by non-planar surfaces. These surfaces are characterized optionally by a curved line.

Right-angled arrangements of flat surfaces are however preferred, as any tensile loads in the x-direction and the compression load due to the weight of the wall in the z-direction lie normal to the surfaces in such a case.

Additional recesses or bulges are conceivable, e.g. additional steps.

However, certain conditions and symmetries must be satisfied as each surface must be complementary to an opposite face to avoid gaps when joining the module surfaces together. Exceptions here are the front and rear surfaces that have no opposite surface and normally define the visible outer surfaces of the wall.

It is preferable that several of such modules in this invention can be joined together so that these can form a wall that can be built and later reversibly dismantled and create, at least in the x-direction and/or y-direction, a friction or form-fit wall surface when in the interlocked state.

The wall surface construction in the stacking z-direction is preferred as an alternating arrangement of courses of modules, wherein the preference is for the modules in a course to be rotated by 180° about the x-axis and/or y-axis relative to the modules in the courses above and below. In general, the modules of the next course in the x-direction must in addition be shifted sideways. The preference is that the shift length be equal to half of the module length in the x-direction. If the module however has no mirror-plane in the y/z-plane, other shift lengths in the x-direction are possible.

Moreover, the modules of the next but one course in the stackable z-direction preferably make no contact. It is preferable that at least one surface of the module makes an angle of 60° to 90° with the x-axis, preferred is 75° to 90°, more preferred is 85° to 90°, even more preferred is 88° to 90°; the greatest preference is 90°. At 90°, the surface is vertical.

In the form-fit joining of the modules, the connecting partners without gravitational or lateral force in the direction of movement already form a mutual obstruction. With loadings on the wall surface in the x-direction, the compression forces act normal in a right angled arrangement, i.e. perpendicular to the surfaces of the partner at the joint. A locking occurs in the x-direction. This means that a hindrance to movement in the x-direction is achieved without any additional means, e.g. mortar/adhesive/bolts. The constructed wall therefore remains stable in the face of tensile loadings in the x-direction.

The deeper the recess, the better is the locking surface per unit volume against tensile loading in the x-direction. In analogous fashion, this applies also to the height of an upper bulge.

Several of these modules can be joined together in such a way that these can form a wall surface in the combined state and this wall surface can be built and dismantled without loss so that the modules can be used again. A decisive advantage of the invention is the reusability of the modules. No aids such as mortar or the like are needed in constructing the wall. Modules can be dismantled, preferably in the z-direction. In addition, the modules have an improved friction, form-fit locking due to their greater surface area. Preferred are several of these modules at least in the x-direction and/or in the y-direction and/or in the z-direction that can be joined together using friction force so that these can form a wall surface in the combined state.

The stability of the wall is typically guaranteed by its own weight. A styrofoam wall generally topples more easily. The weight of an erected or stacked wall generally acts downwards in the z-direction. This results in an increase of the frictional resistance at the supporting surfaces in the x/y plane when there is movement in the x- or y-direction. In addition to the locking effect, the larger surface per unit volume of the module therefore also increases the static friction of the modules. This can, if necessary, be increased even further if additional wedge elements are inserted or additional plates are built in—but the preference for the wall surface produced, at least in the x/z-direction according to the invention, is solely due to identical module units. The surface/volume ratio is, for example, increased when the recess of the module is more deeply formed or additional surfaces are present.

In a particular implementation form, lateral insertion of an additional plate (or via rods inserted from above), screws, a wedge or a bolt on the end stop can guarantee a safeguard against slipping of the modules. The modules have been so formed that these cannot be pulled out from above.

In the following, additional surface modulations and steps of the basic shapes in the x/z-plane are described.

A preferred variant has additional steps, extension pieces and/or cutouts.

A step, extension piece or cutout is created when a surface of the module is interrupted. The interruption is characterized by an additional edge and further surfaces at this point. At the boundary of the surfaces, the derivative of the curve of the surface is discontinuous and jumps to a new value.

A step generally produces two new surfaces from one basic surface—giving a total of three surfaces. The basic surfaces are given mostly here with abbreviations in brackets.

As a preference, the inner and/or outer surfaces contain additional steps, extensions or cutouts. In general, the steps, extensions or cutouts lead to a better distribution of the forces when the wall surface is subjected to tensile loadings as the surface per unit volume of the module has been increased.

In a further stage of the invention, the lateral inner surfaces have at least one step. This divides the lateral inner surface into at least two lateral surfaces. An angle of 90° is preferred between the step surfaces. In the preferred variants, three new surfaces arise from one step: two lateral inner surfaces and one upper inner surface. If there is symmetry in the y/z-plane, a recess with e.g. seven inner surfaces will result from a right-angled recess with three inner surfaces. Instead of the lateral inner surfaces, there will result an initial lateral inner surface (ELI), a second lateral inner surface (ZLI) that lies higher than the first in the z-direction and an intermediate middle inner surface (MSI). The middle superior inner surface forms, as does the superior inner surface, an angle of 60° to 90° with the z-axis as a preference—the horizontal orientation is preferred.

The lateral inner surfaces generally have no undercut cutouts in the z-direction as this would mean that the modules can no longer be stacked from above when constructing the wall surface.

As preference, further surfaces along the lateral inner sides can be generated by the use of additional steps. Symmetry conditions and complementarity must however be observed. The additional surfaces generated must always fulfill the conditions of the original surface, as mentioned above. The surface, where the number of extensions in the upper section has been increased by an additional step, must therefore again be taken away as cutout in the lower half of the lateral inner surface of the extension.

In the case of a single step, for example, the three above-mentioned surfaces are generated. In the assembled state of the wall surface, the first lateral inner surface (ELI) is then complementary to the second lateral inner surface (ZLI), either the right or left lateral inner surface, depending on how the rotation is made. The intermediate middle superior inner surface (MSI) also lies on a further middle superior inner surface (MSI), either on the left or right side.

In a special constructional form of the invention, the middle superior inner surface (MSI) is not horizontal but slanted. Preferred is an angle of 20° to 89° with the z-axis, more preferred is 35° to 60°, the greatest preference is 45°. In the case of a single middle superior inner surface (MSI), this is always complementary to the same surface but rotated through 180° about the x- or y-axis.

As a preference, lateral inner surfaces of several steps, preferred is 2 to 15, more preferred is 3 to 5. The more steps there are, the greater is the surface per unit volume of the module and the frictional locking is improved. However, the steps should not become so low that the many right-angled step surfaces approximate to a diagonal in the final analysis. The module then loses its locking effect and the form-fit locking becomes weaker as the modules could slide past each other and break out when the tensile loading is applied in the x-direction.

With additional steps, it is however also possible to increase the depth of the recess. A lowering of the superior inner surface (SI) at the lateral ends of this surface, corresponding to a step in the lateral inner surface, leads to a thickening of the material at the points where the extensions are joined to the main body of the module. Especially in the second constructional forms of the invention where the lateral cutouts above the extensions also coming from above meet the lower recess, the module can demonstrate thin sections. Stress fields can arise here under tensile loading which can lead to extensions breaking under load. In this case, steps in the inner surfaces are advisable. Preferred is therefore one step in the corner between the superior inner surface (SI) and the lateral inner surface.

A module with 1 to 28 flat inner surfaces are preferred; 2 to 19 is more preferred, even greater preference is 3 to 10; greatest preference is 4 to 7.

The length of the steps in the x-direction is mostly defined by the extent of the non-lateral surfaces (especially the horizontal surfaces). In the case of one step, one middle superior inner surface (MSI) exists. Preferred is the total length of the step between 5% and 65% of the overall module length in the x-direction. The height of the step in the z-direction ranges from 5% to 40% of the total module length. With one step, the lateral inner surface of the module in the z-direction is preferred as divided in two halves and two lateral inner surfaces of the same height are obtained—the first lateral inner surface (ELI) and a second lateral inner surface (ZLI).

In preferred variants of the invention, the superior inner surface has one or more extension pieces, cutouts or steps. Cutouts increase the depth of the recess and so reinforce the locking effect in the x-direction. However, the associated complementary surfaces must also have appropriate complementary cutouts, extension pieces or steps.

A cutout in the left section of the superior inner surface (LSI) therefore leads (depending on the rotation option, 180° about the x- or y-axis) to a corresponding extension piece in the lower outer surface of the left or right extension (UALE/UARE).

If there are extension pieces in the superior inner surface (SI), an analogous cutout in the corresponding lower outer surface of the extension (UAE) is obtained. The extension pieces also increase the total locking area, which can have an effect on the forces in the x-direction. They therefore improve the form fit locking between the modules in the wall. The limits are to be seen, as with the steps, where the material of the module is fissured and fracture sites can occur. Smaller cutouts with correspondingly smaller extension pieces are more difficult to manufacture and less resistant to breaking off than larger extension pieces with high material thickness.

In one special constructional form, the superior inner surface (SI) has a central extension piece or cutout at the place where the two extensions come together. In this special case, the complementary extensions at the lower outer surface have a corresponding counter-cutout or counter-extension piece. Preferred is that a central extension piece as the middle pin in the recess leads to a cutout at the extreme lowest corner of the relevant extension. In a special case, the pin lies exactly in the middle of the module.

In general, all surfaces, additional extension pieces and cutouts can show which surfaces overlay the basic surface. The basic surfaces in this document are indicated by combinations of letters and a list of the basic surfaces is shown at the end of the description. Further sub-surfaces arise within the basic surfaces of the module. In the case of very large extension pieces/cutouts, simple, new basic surfaces are in principle created; the transition between an extension piece/cutout and basic surface is a smooth one.

However, neighboring surfaces in the wall must be appropriately complementarily shaped and when the modules are to be stacked in the z-direction, the undercutting in the z-direction is to be avoided. It is therefore preferred to have no cutouts in the x-direction in the lateral surfaces that do not lie at the lowest or highest edge (in the z-direction) of the module and one extension piece at the most in the x-direction.

The extension pieces can have right angles and then have as corresponding preference, right-angled tooth form with three additional surfaces. Alternatively, the extension pieces shall run to a point or have a pyramid shape and preferably have two surfaces. Variants with non-planar or curved surfaces are also possible.

Preferably, a surface has at least one rise and one trough, e.g. a sinusoidal extension piece and/or sinusoidal cutout. Both of these next to each other result in a complete sine wave. The rise and trough can be in the form of a 0/1 function or another rising/falling function. In the middle, rising surfaces and the corresponding trough surfaces cancel each other out.

In a special constructional form of the invention, the superior inner surface (SI) has at least one sinusoidal extension piece and/or sinusoidal cutout.

The sine wave can form part of the superior inner surface (SI) or its complete length.

It is important that the complementary surfaces on the lower outer surfaces of the extensions (UAE) have a complementary sine wave.

In a special variant of the invention, the superior inner surface (SI) has two complete sine waves, where each a counter sine wave to the two lower, outer surfaces of the extensions (UAE) complementary to this section of the superior inner surface (SI) are correspondingly and complementarily present.

The height and length of the sine wave can be varied. Preferred are 2 to 8 sine waves per basic surface, more preferred are 3 to 5 complete sine waves. The extension piece and the cutout, both with sinusoidal shapes, can however also exist separately on the basic surface.

In a preferred variant, the left section of the superior inner surface (LSI) and the right section of the superior inner surface (RSI) exhibit a complete sine wave, which however preferably does not lie along the entire section length. Between these, the superior inner surface (SI) still exhibits the original basic surface which is, as preference, a horizontal surface. This gives a better seating.

The corresponding complementary surfaces on the lower, outer surfaces of the extensions (UAE) also have sine waves.

The extension pieces or cutouts with sinusoidal shapes have particular advantages. In the stacking, the module slides into the correct position on the underlying module due to the rounded surface and its weight, even when it has not been placed quite exactly on the one below. In addition to that, there is also the double locking in the x-direction.

Additionally, overlaid extension pieces or cutouts have the advantage of increasing the locking of the modules against tensile forces. However, modules with flat lower outer surfaces (UA) are easier to stack individually. Whether one form or the other is better depends on the application.

In preferred variants of the invention, each horizontal surface is characterized by at least one step, cutout, or extension piece or preferentially of a complete (preference is continuous) sine wave. This maximizes the locking effect in the z-direction as, in the final analysis, each surface contributes to the locking—with the exception of the front and rear surfaces.

It is preferred that the module of the invention has at least three surfaces and locking surface in the x-direction.

Preferably, the module has 4 to 8 surfaces, preferably 4 surfaces, and a locking surface in the x-direction.

Basically, it is advantageous when the tensile loading in the x-axis does not lie solely on one surface. Several lateral surfaces inserted at different positions in the x-direction by the addition of steps, cutouts or extension pieces distribute the tensions in the module.

In an extension to the invention, the module has more than one lower cutout at the lower outer surface (UA), which produces a cavity leading upwards. Preferred in this are 3 to 10 cutouts. It is however preferred that only one of these cutouts is a recess in the sense of the invention, into which two extensions from neighboring modules in one course of the constructed wall can be inserted. Further cutouts can have the same form as the recess, but in this case the complementary surface to this cutout is an additional extension piece of a single module. As preference, the module has an odd number of surfaces.

In an alternative design, several modules can be firmly joined together at the lateral outer surfaces. These then form a module combination, which extends over several modules of the wall.

The module according to the invention has preferably at least one rotational symmetry and/or mirror-plane symmetry. Symmetrical modules are easier to manufacture.

The module is characterized by the fact that constructing a wall surface by rotating through 180° about the y-axis or x-axis, the extensions of two adjacent lateral modules come to lie in the particular recess of the module in the course above or below. A closed surface results and, conversely, the modules can be cut out from an already existing panel without loss of material.

If the module has a mirror-symmetry in der y/z-plane, then the halves of the module have additional preference in the rotational symmetry with 180° rotation about the y-axis. Half the area of the recess then corresponds preferentially to the surface of one of these extensions forming the recess.

Preferred, the overall module has a rotational symmetry with 180° rotation about the z-axis, e.g. U-shaped modules. Crossover-compatible modules have, however, no rotational symmetry with 180° rotation about the z-axis. The latter also have no mirror-plane symmetry in the y/z-plane. Here lie the surfaces on the left module side (seen from the front) that are compatible with those of the right half and vice versa.

Preferred, the module has no rotational symmetry at 180° rotation about the y-axis and/or x-axis.

Forms with upper and lower recesses (H-shape) can however have rotational symmetries at 180° rotation for all main axes.

Preferred, the module has mirror-plane symmetry in the y/z-plane. The section through the half of the extent of the module in the x-direction then gives exactly half of the module area volume.

The first and second constructional forms of the invention also have a mirror-plane symmetry in the x/z-plane as preference. This is important for penetration modules in the y-direction in which the front side profile matches the rear side profile.

Preferred, the stackable module has, according to the invention, no mirror plane symmetry in the x/y-plane.

The constructional forms described so far have achieved a locking of the modules in the x-direction. This locking takes place however only between a double course of modules. It is therefore a further problem/task of the invention to make a module available with which a wall surface can be erected in which all courses are locked against slipping in the x-direction. The wall surface should be inherently stable and be able to have small holes if necessary. In preference, the modules in the wall surface are joined together in a perfect fit. The minimum requirement is that several lines of contact or points of contact are necessary between the module surfaces.

To obtain a continuous locking of the wall surface in the x-direction, a further constructional form will therefore be described.

For this, there are basically two variants. In the first variant, the lower recess principle of the first construction form above will be applied. This leads to an H-shaped module (H-shape).

In the second variant, the module has a bulge at the top instead of a recess. This leads to an upper hump that can be completely analogous to the lower recess, only reversed: where the recess had no surface (cavity) there is now the surface of the bulge and where at the bottom left and right the extensions were, there is now a cutout. In contrast to the angular (inverted) U-shape, this module has cutouts top left and right, and is therefore referred to as an (inverted) V-shape. This is preferred when stacking as a tower.

The V-shape in the wall surface—if this is surrounded by elements—is always surrounded by six elements: 2 above, 2 below and 1 on each side. The H-shape is always surrounded by four elements.

In the preferred construction form, the module consists of at least two upper extensions in the z-direction and at least one upper recess reaching downwards in the z-direction bounded by these extensions in the x-direction and lying between the said extensions.

Preferred is that the module consists of at least two upper extensions and at least one upper recess. This form is preferably H-shaped.

With the H shape, the module therefore consists of at least two lower extensions and at least two upper extensions where the two upper extensions extend further upwards in the z-direction than an upper recess in the x-direction lying between these extensions.

The module with the H-shape has preferably a mirror plane symmetry in the x/y-plane, preferably at half the total height in the x-direction. The H-shape has also, as preference, a mirror-plane symmetry in the y/z-plane and the x/z-plane.

The H-shape has, due to the double clamping effect, a very good locking effect both below and also in the upper half of the module in the x-direction. It is compact, highly symmetrical and therefore easily manufactured. In addition, the middle areas are reinforced where the extensions are joined to the main body of the module so that these junctions are reinforced and the extensions can withstand greater stresses.

The H-shape has, in addition to the surfaces of the lower recess, and as already described for the U-shape, preferably further surfaces. Basically, these upper surfaces correspond preferably to the same surfaces for the lower recess.

The H-shape therefore has preferably lateral inner surfaces (LIO) in the upper recess, preferably a left lateral inner surface (LLIO) and a right lateral inner surface (RLIO). These are preferably arranged vertically.

Between these lateral inner surfaces, is located a (lower) inferior inner surface (II) of an upper recess which is preferably horizontal or can form similar angular ranges with the x/y-plane analogous to the superior inner surface (SI).

The upper extensions are also preferably characterized by the lateral outer surfaces of the upper extensions (LAEO) and by upper outer surfaces of the extension (OAE); the upper, outer surface of the left extension (OALE) and the upper, outer surface of the right extension (OARE) are preferred.

These upper, outer surfaces are preferably compatible with the corresponding inner surfaces of the upper recess, i.e. the left section of the inferior inner surface (LII) and the right section of the inferior inner surface (RII)

It is however a property of the H-shape that this can also be stacked without 180° rotation. The lower outer surfaces of the extension (UAE) then lie on the inferior inner surfaces (II) of the upper recess.

Similar to the lower recess, the H-shape can also have steps and so have a first lateral inner surface of the upper recess (ELIO), a second lateral inner surface of the upper recess (ZLIO) and a mid-inferior inner surface of the upper recess (MII) or even further additional surfaces.

Besides that, all surfaces with additional cutouts or extension pieces can be overlaid. In a variant with special preference, the H-shape has full sine wave or another step function or rise/trough at each of the lower, outer surfaces of the extension (UAE) and the upper, outer surfaces of the extension (UAE). The superior inner surface (SI) and the inferior inner surface (II) are also formed with two complete sine waves. This increases the locking effect in the x-direction.

In a further preferred construction form of the invention, the stackable module consists of at least two upper cutouts in the z-direction and at least one upper bulge in the z-direction upwards delimited in the x-direction by these cutouts and lies in the x-direction between these upper cutouts.

The upper bulge in the V-shape case is analogous to the lower recess and has the same edge profile, the only difference being that the surface regions are reversed, i.e. wherein the module has volume in the lower region, there is an empty position/cutout in the upper region and vice versa.

The upper and lower regions lie preferably above or below the half-height of the module. However, the above condition only applies as long as there is no central strip, as described below. In this case, the upper and lower regions begin in each case at the central strip.

The module has preferably an upper bulge. The V-shape therefore has cutouts at the top left and right of the bulge between the two.

The V-shape of the module achieves a locking effect in the x-direction, both below due to the recess and in the upper half of the module with the bulge. In this variant, the depth of the recess can be increased as there is a bulge instead of a recess in the center of the upper side. This creates a very large locking surface per module volume.

In a special variant, the V-shape can be stacked to form a tower with unbroken outer surfaces in which only the V-shaped modules are directly stacked on each other without lateral offset. The V-shape achieves a very high surface to volume ratio and has many locking surfaces without occupying a large volume.

In principle, it would also be possible to implement a double V-shape, i.e. a shape that has a bulge in both directions. This form however has a large volume for the total locking surface achieved. This module is also not protected against tensile stress in the x-direction. That V-shape is better in which there is a recess on the lower side and a bulge on the upper side. This module achieves high x-axis stability for a low amount of material.

Instead of extensions, the V-shape has cutouts at the left and right. The V-shape therefore has preferably only outer surfaces in the upper half of the module, which are where in the H-shape, in analogy to a recess, the surfaces are, just reversed—i.e. outer surfaces now instead of inner surfaces.

This module therefore has a curved or V-shape. This shape channels the force due to the weight optimally from above into the individual module elements. It makes use of the curve or cupola principle and therefore represents an optimal compromise between the curved shape and a rectangular solid. The weight, which is applied at the upper, outer surfaces of the module, is diverted downwards along the extensions. The shape has improved springing and elasticity.

In a preferred variant, the bulge of the V-shape therefore has lateral outer surfaces (LAA): a left lateral outer surface (LLAA) and a right lateral outer surface (RLAA). Left and right refer to the module as seen from the front.

Analogous to the recess connection, the left lateral outer surface (LLAA) is complementary to either the next lateral outer surface (LLAA) on the left or the right lateral outer surface (RLAA) of the module in the next course, depending on whether the module is rotated through 180° about the x-axis or the y-axis.

When constructing the wall, the modules of the next course in the wall are each rotated by 180° about the x- or y-axis and joined together. The joining at the bulge is analogous to that at the recesses.

As with the inner surfaces of the recesses, the outer surfaces of the bulge lie on each other, these surfaces must be complementary to each other. The V-shape especially has an upper superior outer surface (SA) of an upper bulge which can, in preferred variants, be divided into left section of the superior outer surface (LSA) and the right section of the superior outer surface (RSA).

In addition, the V-shaped module consists preferably of upper, outer surfaces of the bulge cutout (OAA) at the left and right edges in the x-direction.

These serve as bedding surfaces for the upper superior outer surface (SA) of the module in the next course. The module has preferably an upper outer surface of the left bulge cutout (OALA) and an upper outer surface of the right bulge cutout (OARA). These surfaces are preferably horizontal. When constructing a tower, the lower outer surfaces of the extensions can lie on these.

When constructing the wall, the left section of the superior outer surface (LSA) either lies next to the upper, outer surface of the left bulge cutout (OLA) or the upper outer surface of the right bulge cutout (OARA), depending on the rotation about the axis x- or y-axis. These surfaces must then be complementarily formed. The length of the upper, outer surface of the left bulge cutout (OALA) in the x-direction then corresponds to the length of the left section of the superior outer surface (LSA). This applies in the same fashion to the right side. The overall length in the x-direction of the upper, superior outer surface (SA) is equal to the sum of the lengths of the left and right outer surfaces of the bulge cutouts.

The total surface therefore alternates between the courses via extensions and recesses or between adjacent courses connected via two bulges. The modules in a course come in contact via the lateral outer surfaces of the lower extensions (LAE). Two adjacent modules are secured against being pulled apart in that one module lies below or one lies above.

The module with the V-shape has no symmetry plane in the x/y-plane.

In preferred variants, the superior inner surface (SI) of the lower recess lies at the same height in the z-direction as the upper, outer surfaces of the bulge cutout (OAA). This height corresponds mostly to half of the total height of the module.

The V-shape can in the basic variants also be so described that the surface can be divided into 3 adjacent rectangles that are firmly fixed together: left and right rectangles and a middle piece. The left and right rectangles are located to the left and right of the line with which the lateral inner surfaces of the lower recess intersects with the x-axis. The two left and right rectangles together then have preferably exactly the same area as the third rectangle of the middle piece. The large middle rectangle is located in the module in the x-direction between the two small rectangles.

As already described for the recesses, the module can also have a further step at the lateral outer surfaces of the upper bulge. Further surfaces are so generated.

In further development of the invention, the lateral outer surfaces have at least one step. This means that the lateral outer surface is divided into at least two lateral surfaces. Preferred are 90° angles between the step surfaces. In the preferred variants, three new surfaces, two lateral outer surfaces and one upper, outer surface are generated by one step.

To the left and right then emerge a first lateral outer surface of the bulge (ELAA), a second lateral outer surface of the bulge (ZLAA) that lies higher in the z-direction than the first and an intermediate middle superior outer surface (MSA), instead of the single lateral outer surface.

The middle superior outer surface (MSA), formed just like the superior outer surface, has a preferred angle of 60° to 90° to the z-axis; the preferred alignment is horizontal.

As preference, further steps can be used to generate even more surfaces along the lateral outer sides. The symmetry conditions of these surfaces are however to be noted. The additional surfaces generated must always satisfy the specified conditions of the original surface. Basically, the growth in area by the addition of a corresponding step to the extensions in the upper section must be removed from the lower half of the lateral surface of the extension in the form of a cutout.

With a single step, there result, e.g. the three above-mentioned surfaces. In the assembled state of the wall, the first lateral outer surface of the bulge (ELAA) is then complementary to the second lateral outer surface of the bulge (ZLAA), namely either the right or left, depending on how the rotation is made. The intermediate middle superior outer surface (MSA) also lies on a further MSA, either the right or left side.

In a special constructional form of the invention, the middle superior outer surface (MSA) is not horizontal but inclined. Preference is for an angle of 20° to 89° to the z-axis, a greater preference is for 35° to 60°, the greatest preference is for 45°. With a single middle superior outer surface (MSA), this is always complementary to the same surface rotated by 180° about the x- or y-axis.

Preferred is that the lateral outer surfaces have several steps, preferred is 2 to 15, a greater preference is for 3 to 5.

The preferred overall length of the step in the x-direction is between 10% and 75% of the module's overall length in the x-direction. The height of the step in the z-direction ranges from 15% to 80% of the total module length.

In the preferred variants of the invention, the superior outer surface has one or more extension pieces, cutouts or steps. The complementary surfaces to these must however also have the corresponding complementary cutouts or extension pieces or steps.

In a special constructional form, the superior outer surface (SA) has a central extension piece or cutout at the position where the two lower extensions of the next course come together. In this special case, the complementary upper, outer surfaces of the bulge cutout (OAA) have a corresponding cutout or extension piece.

The bulge surfaces can also be preferred with an overlaid sine wave. Especially preferred is the superior outer surface (LSA), preferred with at least one, preferably two complete sine waves. Correspondingly, the upper outer surface of the left bulge cutout (OALA) and the upper outer surface of the right bulge cutout (OARA) each has then a complete sine wave.

In the middle section between the upper and lower regions with the relevant recesses or bulges, a central material strip can be preferred. The central strip is not intersected by any recess or cutout.

This central strip has, in the z-axis, a preferred height of 5% to 70% of the overall module height, even more preferred is 10% to 35%.

The central strip has preferably the greatest extent in the x-direction.

Basically, the module is preferred without cavities. That saves material and allows a simpler processing. The module has, in particular, no cavity in the x/y-plane. Furthermore, interlocking points which prevent movement in the wall in the y-direction are a feature of the module. These features will be explained in more detail in the following section. For a better understanding of this, several terms will first be defined and summarized.

---

Interlocking point = protuberance + hollow on the front or rear side of the module
Interlocking point pair = 2 interlocking points with different locking directions positive/negative (protuberance + hollow each on front and rear sides of a module)
Proximal interlocking point pair = 2 interlocking points in direct succession in the x-direction
Double interlocking point pair = 4 interlocking points for absorbing bending moments in one axis
Triple interlocking point pair = 6 interlocking points for absorbing bending moments in two axes

---

Basically, the invention concerns a stackable surface module, wherein the module consists of at least two interlocking connecting elements at the interlocking points. Such elements are preferably protuberances and complementary hollows.

The stackable module has preferably interlocking points wherein each interlocking point consists of surface modulations with at least one interlocking protuberance from the basic surface level and an interlocking hollow that is complementary to this protuberance so that surface modulations on neighboring modules in the assembled state of the wall can form an interlocking bond, wherein, at the interlocking point, the curve of the surface modulation in the y-direction is not continuously parallel to the y-axis so that an interlocking bond forms a form-fit locking at least in the y-direction normal to the wall or shell surface.

The surface modulation at the interlocking point is not continuously parallel to the y-axis; but it can run continuously in the y-direction.

This curve produces a surface at the interlocking point along the module perimeter which, at least at one point, is not parallel to the y-axis. As a result, a y-axis locking with the next module is not possible at this point.

With a discontinuous curve in the y-direction at the interlocking point, a (preferably vertical) locking surface results which locks in the y-direction. The vertical surface is preferred; this lies at a right angle to the y-axis.

Alternatively, the curve at the interlocking point in the y-direction can be completely continuous, which leads for example to a sloping edge. This shape is however not preferred because, when there is pressure from the front on the modules in the wall, forces can result that are not normal to the y-axis. There is a danger here that the neighboring modules slide apart. It is therefore better to have a discontinuous curve and preferably, at least in part, a vertical locking surface.

If the interlocking point is therefore examined along the y-axis, the module does not extend at this point along the entire y-axis. If the interlocking protuberance is at the front of the module, then there is an empty location behind the protuberance in the y-direction. Vice versa, if a hollow is at the front in the y-direction, the module material lies to the rear of this hollow. Expressed in a different way, the module is preferably thinner at this x/z position in the y-direction than the maximum y-extent.

A finger-shaped or similar interlocking protuberance is preferred.

Depending on the rotational conditions when assembling the next course of modules, the elements of the interlocking point as well as the interlocking point protuberance can therefore be formed on one side as a complementary interlocking hollow, i.e. on the front side of the module or on the rear side or mutually opposite. These are however preferably in the y-direction one behind the other, giving a greater effective locking surface at this point along the module perimeter. The protuberance of the lower module then reaches, e.g. at the front, into the hollow of the next module, while in the y-direction behind that, the protuberance of the upper module reaches into the hollow of the lower module. Owing to the one-behind-the-other positioning of protuberance and hollow, a large locking surface is created at this point, thereby giving an effective locking in the y-direction.

The interlocking protuberance is preferred on the front side (seen in the y-direction) and the corresponding hollows on the rear side of the module.

In a special arrangement, protuberance and hollow in a module do not lie behind each other, but are offset in the x-direction or in the z-direction next to each other. The preference is for both to be next to each other.

In an alternative development, protuberance and hollow lie further apart in order to absorb bending moments in the particular axis.

If an interlocking protuberance lies on the front side, the complementary interlocking point hollow of the same module either also on the front side or on the rear side depending on whether, during an assembly of the modules in building a wall or shell, the modules are to be rotated relative to each other by 180° about the x- or the y-axis when being stacked in the z-direction.

Preferred is that the module has at least two layers with different protuberance levels, i.e. a step discontinuity in the surface in the y-direction. Especially preferred is a digital curve of the surface profile at the interlocking point in the y-axis.

The additional step results in the basic surface in the y-direction now being split into steps at two z-levels. At the boundary surface between the courses, a new intermediate surface (or locking surface) is formed that is preferably parallel to the x/z-plane and so preferably parallel to the front or rear side of the module. The size of the intermediate surface depends on the difference in the level of the course volumes at the interlocking point. If a hollow immediately follows a protuberance, then the area of the intermediate surface is optimized.

In most cases, the newly created surfaces, just like the basic surfaces on which they are based, are aligned to be horizontal or, with lateral resulting surfaces, vertical and flat. With an intermediate surface parallel to the x/z-plane, the locking effect in the y-direction is optimal and the interlocking points cannot slide past each other.

Preferably, further surfaces are so created that they can be used as a seating or for the joining together of modules. The new surfaces can exist at various levels in the z-direction and so form terraced structures with level differences.

In an especially preferred development of the invention, the interlocking points have two courses, e.g. in the form of a 1-0 profile. This gives rise to a y -locking surface at the step running parallel to the z-axis between two horizontal surfaces running in the x/y plane. This results in a step-function in the y-direction. Corresponding surfaces of the next module can lie on the surfaces in the x/y plane. The step function with two (1-0) levels is preferred although three (1-0-1) are possible. The variant with only two courses has however the advantage of being able to provide especially thin walls without having to dispense with interlocks. Interlocks with three courses are known in state-of-the-art technology. Each course however requires a minimum wall thickness (depending on the material strength) to guarantee resistance to fracture. The present solution with only two courses economizes on material so that thinner walls can be built without toppling over.

It is preferred that the protuberance, which can form a new step, has a depth of up to a half of the y-direction. This means that a new boundary surface arises at the half-way point in the y-direction depth—the intermediate surface or locking surface. This is preferably flat and vertical (i.e. parallel to the z-direction) so that the interlocking point elements can be slid in from above. Undercuts in the z-direction are therefore not preferred at the interlocking points.

The interlocking point consists preferably of at least one locking surface on a y-axis position which lies between 40% and 60% of the maximum y-axis depth of the module. This means that the application of force at the locking surface is close to the mid-point of the wall and therefore more favorable than in the boundary regions. Near the mid-point in the y-direction is the optimal point for locking against tilting or breaking out of individual modules from the wall.

More preferable is the exact half-way position of the locking surface within the y-thickness. This has the advantage that the locking surface lies at the structurally strongest position and the material thickness on both y-direction sides is roughly the same. Optimally thin walls can therefore be prepared that, in the ideal case, are considerably thinner than previous variants with a 3-layer interlocking point at which the wall thickness has to be about 50% greater than with an interlocking point that only has two courses.

In a special development, two interlocking point pairs lie one behind the other in the y-direction and form the extension and recess system described below. This system requires 3 courses and therefore represents in the basic version a 1-0-1 step function in the y-direction. The invention therefore consists preferably of a stackable module wherein at least one lateral surface of the module is a mortise system and further lateral surface is a tenon system complementary to this mortise system.

In this case, two or more steps in the y-direction are preferred at an interlocking point. The continuous curve with a step between the interlocking points can, with two sloping edges, lead to a V-shape or a notch. The corresponding edge is the complement to the notch. This surface modulation locks in both y-directions and therefore serves as an interlocking point pair where, in this case, both interlocking points of the pair lie one behind the other in the y-direction.

In a preferred variant, the interlocking point has however a digital curve as vertical surfaces are produced that can absorb lateral forces at right angles. The step function (1-0-1) also has two interlocking points (1-0 and 0-1).

Even more steps are possible and increase the lateral stability of the wall surface, these are however only conditionally preferred as this runs counter to the aim of keeping the wall thin in the y-direction.

A special variant of the interlocking point is the mortise and tenon system. Conceivable are however also dovetail joints and other complementary constructions which achieve a positive, form-fit joint in the y-direction. The joint elements are firmly connected to the surfaces on which they are mounted/formed.

In the case of the dovetail joint, this runs preferably from top to bottom in the z-direction along the entire surface. One surface has a convex shape; the other surface has the concave complement.

The modules are held together in the y-direction by the form-fit in these interlocking elements and a locking effect is achieved in the wall surface in the y-direction that can also absorb bending moments. This means that the modules are also protected against tensile movements and forces in this direction as well as against rotation and tilting. In all these cases, the module is no longer continuous in the y-direction.

In a special variant of the invention, the y-axis locking is achieved by the creating/cutting out of two identical modules that are continuous in the y-direction and these can be mutually offset or rotated/tilted by 180° and irreversibly joined to the front sides or rear sites (e.g. bonded). This produces, e.g. a double sine wave from a complete sine wave surface as described below. The offset length then corresponds to the half wavelength so that a wave dip comes before a wave peak and vice versa. This shape can be cost-effectively produced as a casting.

The mortise and tenon system is not preferred along the complete surface. A lock at only one point would however have the disadvantage that around this point the wall could absorb the rotational forces and the loosening of a module under high compressive or tensile forces would be possible. Individual sections of the module should therefore be preferably fitted at more than one point with the connecting systems or locks.

In addition, it is preferred that the mortise system or the tenon system has no undercutting in the z-direction. The modules can then be stacked on each other from above. The next module can then be led along the mortise or tenon when inserting it.

Preferred as protuberance is a rectangular finger and, as the hollow, a complementary rectangular cutout. The classical extension and recess system with a rectangular cutout and corresponding pin has three additional surfaces (a step). This variant therefore produces new surfaces (as with the tenon piece in the x/z-plane described above). In the profile view from above in the z-direction, 5 new edges of the 5 surfaces of an extension then appear, as well as the same number of surfaces in the mortise surface. The wall thickness in the y-direction must thereby be divided into three equal parts and an adequate thickness of tenons in the y-direction must be ensured in the case of thin walls.

In a second alternative, the mortise system is a notch and the tenon system a complementary pointed, tapered edge protuberance. Here, the lock in the y-direction is achieved with merely two surfaces, which taper to a point in the x-direction. In the view from above, a triangular section can be seen. These surfaces do not form a right angle with the x-axis. The preferred angle is from 30° to 60°, a greater preference is 45°. The front ridge of the tenon can be easily inserted into the notch-mortise and runs preferably, as in the previous system, along all lateral surfaces of the module. The advantage of this system is that only can a change in direction along the y-axis of the lateral surfaces take place and therefore the wall thickness in this direction takes place and so the wall thickness in this direction per surface direction only has to be halved.

However, a sloping surface can also be used as the most general form of the mortise and tenon system. This version is an interlocking element on its own and, in combination with a counter surface that has the same type of slope, forms the interlocking point bond of the surfaces of a lock in the y-direction.

The sloping surfaces run parallel to the axis but do not form a right angle with the z-axis but preferably an angle of 15° to 75°; a greater preference is 45°. A single sloping surface is simpler to form than the mortise-tenon systems, but locks in only one y-direction. It is therefore preferred to add slopes at various surfaces of the module that each lock in one or the other direction.

In this third variant, there are no changes in direction along the y-axis and the wall thickness in this direction can be increased. This achieves thin walls that nevertheless have a high stability in the y-direction.

In this special construction form of the invention with sloping surfaces, the slopes are not continuous in the x-direction. Alternating slopes can also form interlocking point pairs. Two sloping points one behind the other in the x-direction with various angles of slope with the y-axis are preferred. In the preferred variants, the double slopes each form an angle of +45° and −45° to the y-axis. Seen from above, they lie in the crossed over position. However, to be able to join the modules to each other from above, they may not have any undercuts in the z-direction. The lower slope should therefore be cut out lower (in the x-direction) than the upper sloping surface. The sloping surfaces then do not obstruct each other during the construction.

These sloping pairs at the lateral surfaces of the module are preferably present as pairs per surface. The corresponding mating surfaces also have double sloping pairs, which match the complementary surfaces.

The module is fixed at each of these sloping pairs in both y-directions.

The wall thickness in the y-direction can therefore be very thin, despite the high wall construction which is safeguarded against toppling in the y-direction as long as the foundations of the wall are secure.

Up to now, the development of the interlocking elements in the y-direction has been described. In the following, the development in the x-direction will be treated.

The interlocking points in the y-direction have preferably an extent of 5 to 20% of the maximum overall module extent in the x-direction.

The interlocking points should be limited in the x-direction in order to make force absorbing points available and to save material.

The shape of the run of the interlocking points in the x/z-plane can vary. In a first variant, the protuberance or the hole at the interlocking point will be represented by a quadratic 0/1-function in the x/z-plane.

In the course along the x-axis, the interlocking points therefore have a digital step profile. As a preference, a hollow immediately follows a digital protuberance in the x-direction. This increases the lateral stabilization in the x-direction. The toppling in this direction is naturally less of a problem, but shifts of the module surfaces relative to each other, e.g. during earthquakes are also undesirable.

A preference according to this invention is that a protuberance is located at least at one lateral surface of the stackable module and a hollow, complementary to the protuberance, is located at a further lateral surface of the module.

It is further preferred that all lateral and/or horizontal surfaces include interlocking points.

If the horizontal surfaces also have interlocking points, then the wall surface acquires a special stability as the existing rotational forces at the individual modules can be locked by the interlocking points in order to prevent individual modules being levered out of the wall. The horizontal surfaces are usually the superior/Inferior inner surfaces, the lower/upper outer surfaces of the extensions and the upper, outer surfaces of the bulge cutout (OAA).

With these measures, the wall can absorb buckling stresses and the wall thickness can be reduced.

It is essential that the particular opposing surfaces in the wall process are complementary interlocking elements. The complementary surfaces in each case have already been described. In the case of the lateral surfaces, these are preferred as the lateral outer surfaces and the lateral inner surfaces of the recesses. Depending on the symmetry and the axis of rotation in constructing the wall, the protuberance can lie e.g. at the right lateral outer surfaces and the hollow at the left, lateral outer surfaces (analogous or vice versa for the inner surfaces). All 6 lateral surfaces, e.g. in the simplest rectangular H-shape are then fitted with interlocking points.

In preferred developments, the modulation surfaces can form one-sided or two-sided curved surfaces on the basic surface.

In the case of curvature along the x-direction, the course in the x/z-plane can then be described by a curve. The protuberance and the corresponding hollow then form a curve.

In a special construction, the curve is a sine function which has a single-sided curved form in the x-direction. This curvature in the x-direction has several advantages. One is that the assembly is easier. When sliding the modules into each other, the upper module slides automatically into the lower hollow because the module is led into the lowest point of the sine wave by gravitational force.

However, the locking force in the case of the sine wave is lower so that here, depending on the requirement, must be decided which interlocking elements are to be selected.

If the modules in earthquake resistant walls have to be capable of absorbing lateral play, the sine wave would be favorable as the temporary gravitational forces here and even the lateral movements in the x-direction can be absorbed. In the return swing, the wall heals itself because the modules then fall back into their original positions. Energy is consumed by frictional forces. Rubber buffers or other spring elements can also be inserted into the intermediate spaces. Several sinusoidal deflections in sequence in the x-direction are preferred as this increases the hill-valley deflection.

The course of the interlocking point in the y-direction is also typically characterized by a step function, even in the sine wave variant—with two level differences. At both sides of the intermediate surface are surfaces preferably located parallel to the x/y-plane.

It is generally preferred to have two interlocking points also in the x-direction, one after the other or close together. In a direct sequence in the x-direction, this is referred to as a proximal interlocking point pair. Alternatively, a small distance can lie between the maximum of the half-extent of the interlocking and the interlocking points.

With the 0/1-step function in the x-axis direction with proximal interlocking point pairs, the transition from the positive interlocking point to the negative interlocking point is a sharp one, while the transition is smooth with the full sinusoidal function, i.e. the function of the path of the surface edge in the x/y-plane in the course of the interlocking point transition is steady throughout.

A special additional variant of a connecting element is the double sine wave. Complete sine waves have already been described as extension pieces. It is however possible to employ the double sine wave—similar to the double slope-pairs as a y-axis lock. The double sine wave can only lie at horizontal surfaces as the dips in the wave would otherwise be an obstruction.

In this, the complete sinusoidal extension pieces would preferably be divided into two sections in the y-direction: e.g. section-halves at the front and rear, namely for both complementary opposite faces. With horizontal surfaces, there is therefore an upper surface and a lower surface each formed with sinusoidal extension pieces and these pieces each divided into two sections.

The front side of the lower surface then has e.g. a left wave peak and then in the following right wave dip is a cutout or vice versa (with horizontal surfaces the subsequent wave in the x-direction is left or right).

The rear half of the lower surface then has correspondingly inverted wave peaks and wave dips. It is then possible to see from the front side, with the lower left surface, a front side peak and at the right a rear side peak; next to these are in each case are the wave dips.

With the upper mating surface, the waves are arranged exactly in reverse so that the connecting pieces fit exactly when joining these together. No gaps occur where the upper surface has a wave peak and for the lower surface a wave dip, and vice versa.

Two left wave peaks in the y-axis therefore lie together in each case and the surfaces are locked in one direction. The right wave peaks lock in the other y-direction. Similar to the double slope, a lock is achieved in both y-directions.

The double sine wave lies preferably on the horizontal surfaces—for which the sinusoidal extension pieces have already been described.

To enable the locking in both y-directions, the module has an interlocking point pair with two interlocking points.

With the interlocking point pair, at least one interlocking protuberance is preferred at the front side (at the front in the y-direction) and at least one further interlocking protuberance formed at the rear side of the module. The corresponding hollows are arranged vice versa. If both the interlocking protuberances are on the same side then both lock in the same direction. This means that a complete y-axis locking with opposing interlocking points can be achieved at the front and rear.

At least one interlocking point pair is preferably located on the same basic surface of the module. Such an interlocking point pair on a basic surface and especially if the pair lies within an x-axis distance of less than 25% of the total extent of the module in the x-direction (proximal interlocking point pair) demonstrates a particular stability.

In further developments of the invention, the module has three or more interlocking points. An odd number of interlocking points can be useful when the wall stability in a y-direction is to be especially increased. Preferred is however an even number of interlocking points in order to achieve a uniform protection against lateral breaking out of individual modules. Interlocking point pairs are therefore preferred.

The module consists preferably of at least two interconnected point pairs, in other words a double interlocking point pair.

These are preferably not directly next to each other, but lie along the module perimeter—as wide apart as possible.

A special preference is for the development of two interlocking point pairs at different positions along the z-axis. This has the special advantage that the bending moments in the z-direction can be absorbed, so leading to greater stability in the face of toppling, especially with thin walls.

An even greater preference is for three interlocking point pairs as the bending moments in two axes can be accommodated. With three interlocking point pairs, the modules are statically defined. This 3-point solution also makes it possible to build a wall from modules either horizontally or at an angle, without it breaking or falling apart. The application as sloping coastal protection surfaces, as breakwaters or even in the construction of cupolas in a completely overhanging wall would then be possible.

Even more preferable is a multiple interlocking point pair in which each two pairs on a basic surface can be connected to two pairs of another basic surface. This would allow a lock in both y-directions to be reached on two basic surfaces of the module.

Preferred is an interlocking point or an interlocking point pair or proximal interlocking point pair or of double interlocking point pair at an inner surface of the recess or at an outer surface of the extension or at both the lower outer surface of the extension (UAE) and also at the upper superior surface (SI) of a lower recess.

An interlocking point is preferably located at all horizontal and/or vertical basic surfaces.

An interlocking point is preferably located at all horizontal basic surfaces. Even more preferable is the complete universal fitting of all basic surfaces with interlocking points.

The surface modulation should also have a certain length in the z-direction. Preferred is the extent of the protuberance of interlocking points in the z-direction by at least 10% of the overall module extent in the z direction.

The preferred extent of the protuberance of the interlocking points in the z-direction is at least 10% of the total module extent in the z-direction, preferably at least 20% of the total module extent. This ensures a stronger locking that is important, especially in thin-walled systems. A greater locking surface at the intermediate surface is beneficial in absorbing the forces so that the modules cannot break out of the wall.

Furthermore, other surface system combinations with other connecting elements are conceivable so long as they are always complementary to each other. Complementary surfaces are mostly those which would interlock when a module is shifted by the half of a module length and rotation of 180° about the x- or y-axis in order to construct the wall surface. Further connection combinations are, e.g. a 0- and 1-function or other lift/sink functions or step functions.

The construction made from y-axis locked modules can absorb tensile or compressive forces in the transverse direction or torsional or bending stresses along the y-axis.

In the case of the wall surface that has been erected, the wall that has been formed is secured against toppling as long as the base is firmly anchored; the wall is not linearly built as a "paravent" or is sufficiently broad at the base.

This is usually achieved in that wall elements in at least two different heights in the z-direction are fixed (joints, adhesive, etc.) by interlocking points. In contrast to the previous methods, this securing by the fixing at least at two points using connecting elements and not by a wide seating, as is the case with a thick wall or using the homogeneous material of a concrete wall.

In this, no additional components (screws, bolts) are necessary. The wall surface can therefore in principle also be used as a base. In a special constructional form, the module is used to construct a sloping coastal protection wall.

It is preferred that the module has a curvature in one or two directions, preferably in the x-direction and/or the z-direction. With a module curvature in two directions the wall, when laid horizontally, can look like a valley/mountain range—i.e. a landscape can be simulated.

Curvatures can be accepted up to a certain angle. This allows, for example, the building of a cupola using modules as the y-axis locking secures against the falling apart of the modules—even in non-vertical structures.

The interlocking points are appropriately adapted to the radii of curvature and fitted at an angle. The seating surfaces are then no longer flat and parallel to the x/y-plane, but follow the general line of the curvature. When interconnecting the modules, it may be necessary to place them slightly at an angle or, where the curvature is pronounced, to interconnect the modules by following the radius of the curve.

In special variants, the stackable module is so shaped that the module front side surface(s) or rear side surface(s) are not flat but curved in the x-direction and/or z-direction.

It is preferred that the front surface in the x-direction is shortened relative to the rear surface.

These different modules could now be produced so that a wall surface is first built and then sawn or separated into individual pieces. These pieces can then be erected at another place.

The module does not therefore have to be level and flat in the x/z-plane but can also have a curvature. Curvature is preferred in the x-direction but can also be in the z-direction. The curvature describes preferably the arc of a circle where the subtended angle at the center of the circle does not exceed 180°, i.e. a complete circle must have at least two modules. The subtended angle of the arc lies preferably between 1° and 180°, more preferably between 5° and 15°. It is especially advantageous when the subtended angle represents an integer fraction of the full circle, i.e. 360°, so that a circle can consist of several modules. The forming of a circle can be an advantage when building towers as the already pre-formed, curved modules here can be used to make a tower that can be built and dismantled. Furthermore, the module that is curved in the x-direction can also form wave-shaped walls if built so that neighboring modules in a course are rotated by 180° in the x-direction. Care has to be taken here however that the modules in the courses above and below can satisfy the special geometrical requirements of directional changes in the x-direction. In this exceptional case, the wall surface is no longer constructed from a single type of module.

It is therefore basically possible, with a single module shape, to quickly build a curved wall surface without the use of mortar or similar substances and then dismantle it again.

In another variant, the module can be curved in the z-direction. The curve here also describes preferably a circular arc. However, the subtended angle of this arc of a circle should preferably lie between 0° and 90°; especially preferred is between 1° and 10°. As the stacking of the modules should take place in the z-direction, larger angles are not advisable. With a light curvature along the z-direction, curved dike walls or bridges can be formed. It is also possible to use the wall surface as a flat or curved cover.

These structures are then particularly stable when exposed to tensile loads in the x-direction. If the top and bottom modules are securely fixed, the bending stability in the particular y-direction, aligned to be orthogonal to the module front side face, is ensured.

With a module that has a curved shape in both the x- and z-directions; it is furthermore possible to pre-form the rudiments of a cupola without the use of bonding substances.

In addition, in a particular constructional form, the thickness of the module in the y-direction can become thinner upwards in the z-direction in different courses (when the modules are not of the same type). The stability can also be realized by making the lower modules twice or three times as thick (broad) as those modules higher up. These fit together despite the differences in module thickness.

Tapering (round) wall surfaces can also be used in upwind power stations or in power station cooling towers. Larger holes/windows in the wall surface are possible.

In another variant of the module according to the invention, the module next to a larger, thick one, has an interruption in the surface in the y-direction.

In such a case, a cavity is formed within the module that in the x/y-plane is continuous over the entire module height in the z-direction or just a part of the module height. This means that the module can be used as a formwork block similar to e.g. Isorast®. The advantage of such formwork is that it is very stable. The form created with predetermined breaking points can also be separated at these points if necessary. The formwork can for example be filled with bulk solids. A module must therefore be strong enough that the formwork can also accept concrete. The thickness of the formwork walls of the module in the y-direction is 3 to 5 cm with a subsequent cavity of 20 to 30 cm (15 to 20 cm with concrete). The advantage of such a formwork is that it can be re-used. The formwork is very stable.

Plastic covers that can be inflated or filled e.g. with water are a particularly suitable material for the modules. In the inflated state these provide a formwork or hollow mold. This construction has the advantage that after the medium has been filled into the inflated shape; the formwork can be removed, e.g. by letting out the air/water. The formwork is reduced in volume for transport.

The module consists preferably of concrete, wood, perspex, styrofoam, or a mixture of these materials. The materials for the module according to the invention are not particularly restricted. The preference is for concrete, wood, perspex or styrofoam, cast materials of metals, non-ferrous metals, aluminum, wax, bonded press-formed materials (e.g. wood pressboard): there is a particular preference for fiber-reinforced concrete, concrete with steel strands or textile fibers. Further possible materials are glass or acrylic glass.

The materials should be capable of withstanding the relevant compression, tension and bending forces.

These materials have the advantage that they have a particular strength and can meet the tensile strength requirement in the x-direction by interlocking.

A material that is especially preferred is fiber-reinforced concrete. Pure concrete is not very strong in withstanding tensile loads. Especially preferred are sandwich materials and composites.

The main approach here is that the manufacture and re-use of existing modules is very cost-effective, whereas a modification to the module without destroying it, in the simplest case by melting down, is considerably more expensive.

Preferred is that the sides of the modules that are exposed to the sun are painted white or given a mirror-finish as a contribution to climate protection.

To erect the wall, the modules are first placed in a course next to each other. To place the next course of modules, the modules are stacked in the courses above or below by alternately rotating through 180° and offsetting laterally in the x-direction. Preferred in this, is that the next course of modules in the z-direction is offset by half a module length in the x-direction. A different offset can however be necessary when the module has no axis-symmetry with reference to the y/z-axis.

Furthermore, the invention includes a wall surface consisting of stackable modules according to the invention as described above.

Several of the modules according to the invention can form a wall surface according to the method described above where the outer surfaces of the front and rear sides of the individual modules in the x/z-plane of the front and rear sides of the modules that form the wall surface.

A wall system will also be described which includes a variety of modules according to the invention, which can be so interconnected that they form a closed wall surface when in the assembled state, wherein the module has at least two lower extensions that extend further downwards in the z-direction than a recess lying in the x-direction between these extensions, wherein several of the modules can be stacked, each in the z-axis stacking direction, offset in the x-direction and rotated relative to each other by 180° about the x-axis and/or the y-axis. The modules are preferably arranged in the wall surface module courses with the extensions in the z-direction alternating each time with the extensions pointing up or down. Preferred is a wall system with at least three joined module units. The boundary surface between the courses in the wall runs alternately on different line heights. Preferred is that the wall surface consists of at least three identical or similarly formed modules which come in contact with each other (i.e. that are at least three modules necessary for the force transfer).

In the normal case, the inherent weight of the modules reinforces the stability. Styrofoam modules are, for example, more stable the higher they are built. The modules are so interconnected that the fixed anchoring of a module with the joint via another module, leads to the wall not toppling over.

The walls can be stabilized against toppling over in that either a wide base is integrated into the wall (e.g. 40 to 60 cm) or foundations with a plinth set deep in the ground are used or a rectangular wall at the side, which serves as a retaining wall, is used. In this, the wall system can still have side supports that guarantee against toppling over.

The plinth can be built from at least 2 stacked courses of modules, one on top of the other, or two courses of modules next to each other in the y-direction that then no longer topple.

The modules of the wall system are preferably laid in different courses that do not have the same thickness. Preferred is a wall thickness that tapers off in the upwards direction.

In a special constructional form, the modules are mutually offset in the y-direction. These wall surfaces are then each shuttled back and forth in the x-direction arrangement. This allows a folded wall surface to be constructed according to the principle of the paravent. In special cases, the modules are so formed that a right-angled fold in the wall surface is possible without projecting.

Preferred are modules in the wall surface in the x-direction that are so alternately aligned that an angle between the modules is less than 180°. With an angle of 180°, the modules would give a straight wall surface. The result is a folded wall surface corresponding to a paravent.

With curved modules, it is possible to construct a curved paravent that has a greater resistance to toppling over.

It is a special feature of the invention that the wall system or the wall surface produced on the upper side is not flat and level. This runs in fact preferably at different heights.

Furthermore, the wall system or the wall surface according to the invention preferably includes closing pieces to fill the outer gaps in the erected wall surface and obtain a flat outer surface for the erected wall.

Ideally, there are end caps on all sides of the wall surface that can fill the protruding cutouts and recesses so that a gap-free rectangular wall surface is formed. The end caps are preferably made from the same materials as the modules in order to guarantee a uniform looking wall. In specially preferred cases, the end caps are made from sawn-off, cut or otherwise manufactured parts of the modules according to the invention. This guarantees the uniformity and general stability of the wall.

The use of a module or wall system according to the invention for the construction of a wall surface is also described. The wall surface can also be part of a wall, of a garden fence or similar.

The module according to the invention can also be used to build a bridge, the cupola of a compost shed, a site fence, a tower, an upwind power station, a power station chimney, a round wall, a site fence, a noise protection wall, coastal protection, a terror defense wall, a reservoir, a toy house, a heat exchanger, a jigsaw puzzle, miscellaneous toys, trade fair structures, an earthquake-proof wall or as a general, two-dimensional, universally usable form.

It is further possible to use the module for a sloping wall that has an angle of less than 90° to the ground surface. Such a sloping wall can be used, e.g. in coastal protection as a substitute for a dike or as a wave breaker. Sea waves could then, for example, run out gently over a sloping wall surface.

In the use of the module for a jigsaw puzzle in which all parts are identical; the task for the user is to assemble the parts solely on the basis of the picture.

As a two-dimensional universally applicable form, the module can also be used, e.g. for casting materials such as plastics or waxes. This has the advantage that these parts can be melted down again after a few years. The module is preferred as re-usable but in the case of damage is at least recyclable.

The modules can also be cut out of a wall surface for erection later on site.

In defense against terror, the modules have the advantage that no screws etc. can be loosened as no screws are necessary. High walls can then be quickly and reversibly erected as protection against hostile attacks. The offset arrangement of the modules ensures a highly intrinsic stability of the wall surface.

With modular walls that have holes for piping systems, it is further possible to install heat exchanger systems in which pipes with different liquid temperatures can come close to each other or even touch.

The wall system therefore also includes as preference pipes for a heat exchanger system. The pipes are preferably laid in the module courses and preferably run in opposite directions in neighboring courses (counterflow principle). Because of the high surface to volume ratio of the present modules, an outstanding heat exchange effect is ensured.

The uppermost module of a wall module can be used for water storage or as a plant trough, when only every second module in the wall is used as an end piece. The intermediate space can then take over the appropriate function. Plant troughs can be built in a similar manner. Such a collar can also be attached at the top of the wall.

The modules are also suitable as a means for building a water reservoir that, in contrast to one made of sheet metal, can also be buried in the ground, i.e. this is inherently stable and can also absorb unevenly distributed loads.

The use of a preset constructional form also allows large buildings to be realized, such as houses or, in the case of curved modules, towers. This has the advantage that these can be used reversibly—construction and dismantling—and so can be easily disposed of or re-used after many years.

BRIEF DESCRIPTION OF THE DRAWINGS

The invention will now be described with the help of the figures and examples.

DETAILED DESCRIPTION OF THE PREFERRED EMBODIMENTS

Figure 1:
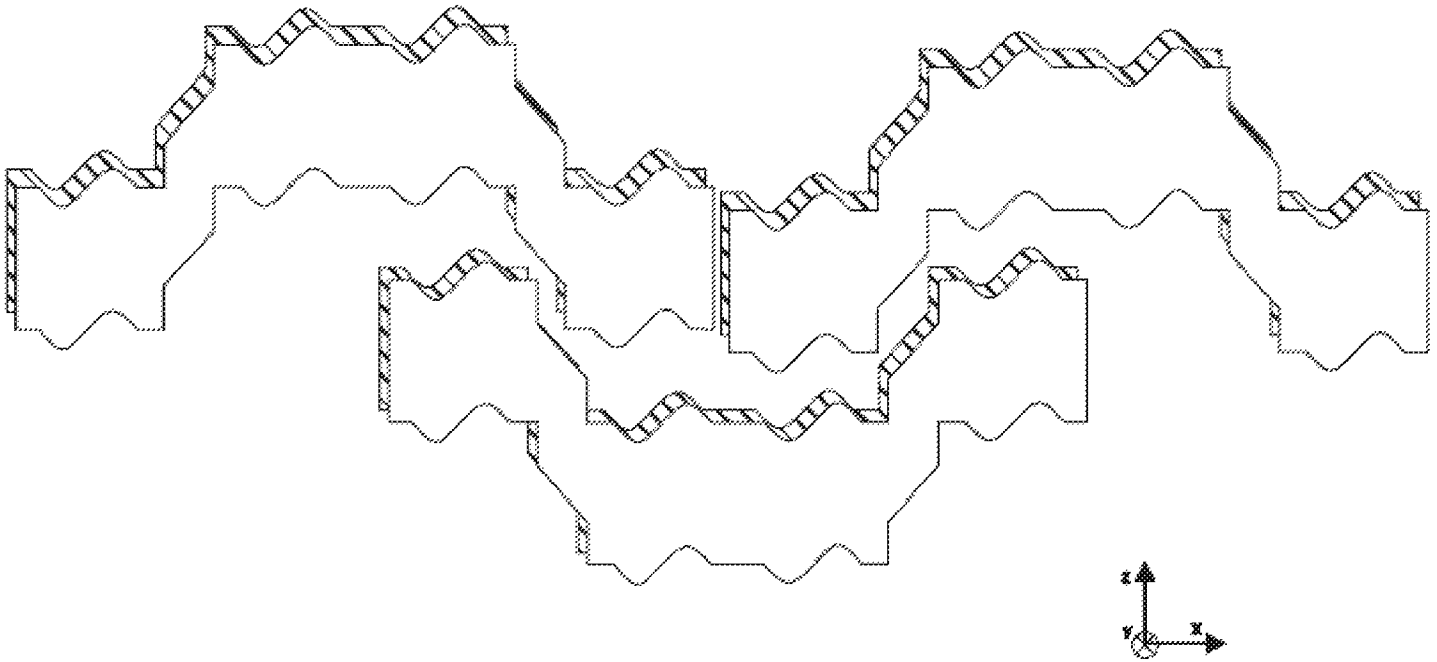
FIG. 1: Basic shape of the modules in the V-shape with several double sine waves in the x-direction on various horizontal basic surfaces
Figure 2:
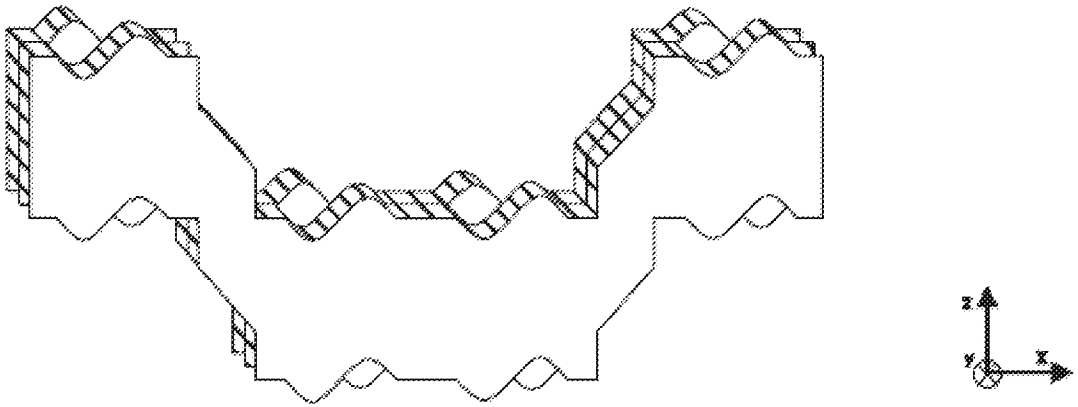
FIG. 2: V-shaped module with double sine waves as interlocking points, formed according to the invention

Now preferred embodiments will now be explained based on the drawings. First, the basic surfaces for the stackable surface module will be discussed.

Basic Surfaces

U-shape
Inner surface (I)
Lateral inner surfaces (LI) of the recess
the (LI) generally correspond to the lateral inner side surfaces of the extensions (LIE)
Left lateral inner surface (LLI)
Right lateral inner surface (RLI)
Upper superior inner surface (SI) of a lower recess
Left section of the superior inner surface (LSI)
Right section of the superior inner surface (RSI)
Outer surface (A)
Lateral outer surfaces (LA)
Lateral outer surfaces of the extensions (LAE)
Lower outer surface (UA)
Lower outer surface of the extension (UAE)
Lower outer surface of the left extension (UALE)
Lower outer surface of the right extension (UARE)
Upper outer surface (OA)
First lateral inner surface (ELI),
Second lateral inner surface (ZLI)
Middle superior inner surface (MSI)

H-shape
The H-shape has as preference, in addition to the above-mentioned surfaces of the U-shape:
Lateral inner surfaces (LIO) of the upper recess
Left lateral inner surface (LLIO)
Right lateral inner surface (RLIO)
(Lower) inferior inner surface (II) of an upper recess
Left section of the inferior inner surface (LII)
Right section of the inferior inner surface (RII)
Lateral outer surfaces of the upper extensions (LAEO)
Upper outer surface of the extension (OAE)
Upper outer surface of the left extension (OALE)
Upper outer surface of the right extension (OARE)
First lateral inner surface of the upper recess (ELIO),
Second lateral inner surface of the upper recess (ZLIO)
Mid-inferior inner surface of the upper recess (MII)

V-shape
The V-shape has, in addition to the above-mentioned surfaces of the U-shape, the following preferred surfaces:
Lateral outer surfaces (LAA) of the bulge
Left lateral outer surface (LLAA)
Right lateral outer surface (RLAA)
Upper superior outer surface (SA) of an upper bulge
Left section of the superior outer surface (LSA)
Right section of the superior outer surface (RSA)
Upper outer surfaces of the bulge cutout (OAA)
Upper outer surface of the left bulge cutout (OALA)
Upper outer surface of the right bulge cutout (OARA)
First lateral outer surface of the bulge (ELAA),
Second lateral outer surface of the bulge (ZLAA),
Middle superior outer surface (MSA)

EXAMPLES

Example 1 (Angular U-shape)

The module is made of plastic and has a constant thickness of 1.5 cm in the y-direction. The maximum extent in the x-direction is 30 cm. The maximum extent in the z-direction is 12 cm. The module has an angular U-shape. Starting with a rectangular basic form having the above dimensions, a rectangular recess is cut out from the lower part in the middle of the x-direction with a length of 15 cm (in the x-direction), a width of 6 cm (in the z-direction) and a thickness of 1.5 cm (in the y-direction). In the following, the module is described when being viewed from the front. The front profile is constant in the y-direction. The edge lengths of the surfaces of the module in the counterclockwise direction are listed in the following, starting with the lower left corner of the module. The angle information is in brackets, starting from the end point of the previous edge corresponding to the normal degree distribution of a unit circle in 360° in the counterclockwise direction (the horizontals in the positive x-direction therefore correspond to 0°): UALE=7.5 cm (0°); LLI=6 cm (90°); SI=15 cm (0°), RLI=6 cm (270°), UARE=7.5 cm (0°); LA=12 cm (90°); OA=30 cm (180°); LA=12 cm (270°). The subsequent surfaces in sequence are therefore always perpendicular to each other.

In a variant made from concrete, all lengths (as all heights and thicknesses) must be multiplied by a factor of between 5 and 15. In the wood variant, the lengths are multiplied by a factor of between 2 and 7.

Example 2 (Simple H-shape)

The module according to the invention is made of plastic and has a constant thickness of 1.5 cm in the y-direction. The maximum extent in the x-direction is 30 cm. The maximum extent in the z-direction is 24 cm. The module is H-shaped. Starting with a rectangular basic form having the above dimensions, a rectangular recess is cut out from the lower and upper parts in the middle of the x-direction each with a length of 15 cm (in the x-direction), a width of 8 cm (in the z-direction) and a thickness of 1.5 cm (in the y-direction). In the following, the module is described when being viewed from the front. The front profile is constant in the y-direction. The edge lengths of the surfaces of the module in the counterclockwise direction are listed in the following, starting with the lower left corner of the module. The angle information is in brackets, starting from the end point of the previous edge corresponding to the normal degree distribution of a unit circle in 360° in the counterclockwise direction (the horizontals in the positive x-direction therefore correspond to 0°): UALE=7.5 cm (0°); LLI=8 cm (90°); SI=15 cm (0°); RLI=8 cm (270°); UARE=7.5 cm (0°); LA=24 cm (90°); OARE=7.5 cm (180°); RLIO=8 cm (270°); II=15 cm (180°); LLIO=8 cm (90°); OALE=7.5 cm (180°); LA=24 cm (270°).

In a variant made from concrete, all lengths (as all heights and thicknesses) must be multiplied by a factor of between 5 and 15. In a wood variant, the lengths are multiplied by a factor of between 2 and 7.

A second module can be set on the first module, offset by a half module length (i.e. 15 cm), so that a positive form-fit between the two modules in the x-direction forms a continuous surface. A third module can now also be set onto the first, also offset by a half module length—but this time in the other direction. The result from all three modules is a continuous, positive form-fit surface. With moderate tensile loading of the second or third module in the x-direction, this can be compensated by the first module.

A continuous surface, resistant to loading in the x-direction, is therefore the result.

Example 3 (H-shape with Sinusoidal Horizontal Edges)

A module with sinusoidal horizontal surfaces can be modeled on the basis of the H-shaped module in Example 2. The module is also made of plastic and has in principle the same basic surfaces as in Example 2.

In a variant made of concrete, all lengths (as well as heights and thicknesses must be multiplied by a factor of 3 to 15. In a variant made of wood, the lengths must be multiplied by a factor of 2 to 7.

Here, each of the six horizontal surfaces (with an angle of 0° or 180°, i.e. UALE, SI, UARE, OARE, II and OALE) has at least one sine wave. The lower and upper outer edges of the extensions (UALE, UARE, OARE and OALE) are so formed that the sine wave starts to rise at the straight distance of 0.75 cm from the left corner of the edge. The gain in area in the case of an upper edge or the loss of area in the case of the lower edge in comparison with Example 2 increases sinusoidally in the x-direction up to a maximum height of 1 cm in the z-direction at a length of 2.25 cm (in x-direction). After that, the height reduces sinusoidally to a minimum value of minus 1 cm in the z-direction and 5.25 cm in the x-direction which represents an area loss/gain in comparison with Example 2. The z-value then increases again and ends at a value of 6.75 cm in the x-direction measured from the left corner of the edge and a value of 0 cm in the z-direction in a horizontal line with 0.75 cm to the next edge point.

In a similar manner, the horizontal inner surfaces (SI und II), whose edge length is twice that of the lower and upper outer edges of the extensions, possess two adjacent sine waves that lie 1.5 cm from each other in the middle.

This H-shaped module therefore has horizontal edges with a total of eight identically formed sine waves that fit flush into each other when stacked.

These sine waves can be represented, as in the description above, as double sine waves. The surface shape is however no longer constant in the y-direction.

Example 4 (H-shape with Mortise-tenon System at the Vertical Edges)

Based on the H-shaped module shown in Example 2, the module with vertical surfaces can be modeled using the mortise-tenon system. The module is again made of plastic and has, in principle, the same basic surface as in Example 2.

In a variant made of concrete, all lengths (as well as heights and thicknesses must be multiplied by a factor of 3 to 15. In a variant made of wood, the lengths must be multiplied by a factor of 2 to 7.

The module does not however have a constant section in the y-direction. Instead, it has a mortise or the corresponding tenon on all vertical surfaces (with an angle of 90° or 270°, i.e. LLI, RLI, LLIO, RLIO, as well as both LAs). There is therefore a 0.5 cm-deep mortise (in x-direction) and 0.5 cm wide (in y-direction) whose overall length extends over the entire length of the surface (i.e. is 24 cm long) on one of the lateral outer sides LA with a y-value of 0.5 cm from the front side. A 0.5 cm-deep (x-direction) and 0.5 cm-wide mortise (y-direction) extends along the surfaces LLI and LLIO. On the second lateral outer side LA is located a tenon that fits into the matching mortise, i.e. an elevation of the surface that begins at a distance of 0.55 cm in the y-direction. It is 0.4 cm high (in the x-direction above the surface), 0.4 cm wide (in the y-direction) and also extends over the complete length of the surface (in this case, 24 cm). The surfaces RLIO and RLI have a correspondingly shorter tenon but with all other dimensions the same.

The reduced dimensions of the tenon compared with the mortise ensure that the system can be easily joined together.

The variations from Examples 3 and 4 can also be combined in a single module.

Example 5 (Simple V-shape)

The module according to the invention is made of wood and is 5 cm thick. In a variant made of concrete, all lengths (as well as heights and thicknesses) must be multiplied by 2 to 5.

The maximum extent in the x-direction is 1 m. The maximum extent in the z-direction is 40 cm. The module has a V-shape. It has only horizontal or vertical side surfaces that are orthogonal to each other. It is mirror-symmetric with reference to the x/z-plane. The module consists in principle of three adjacent rectangles that are firmly fixed to each other where two of the rectangles are the same size and the third is twice as large in area. The large rectangle is located in a module in the x-direction between the two small rectangles. All rectangles have a common side-length of 25 cm. The common side-length lies in the z-direction. The equally long sides of the small rectangles are at one z-height, the side of the large rectangle is at a lower height (15 cm lower) so resulting in the V-shape of the module.

In the following, the module is described when being viewed from the front. The front profile is constant in the y-direction. The edge lengths of the surfaces of the module in the counterclockwise direction are listed in the following, starting with the lower left corner of the module. The angle information is in brackets, starting from the end point of the previous edge corresponding to the normal degree distribution of a unit circle in 360° in the counterclockwise direction (the horizontals in the positive x-direction therefore correspond to 0°): UALE=25 cm (0°); LLI=15 cm (90°); SI=50 cm (0°); RLI=15 cm (270°); UARE=25 cm (0°); LA=25 cm (90°); OARA=25 cm (180°); RLAA=15 cm (90°); SA=50 cm (180°); LLAA=15 cm (270°); OALA=25 cm (180°); LA=25 cm (270°).

A second module can be so set on the first module, offset by a half module length (i.e. 50 cm) and rotated by 180° about the y-axis so that a positive form-fit between the two modules forms a continuous surface. A third module can now also be set onto the first, also offset by a half module length and rotated by 180° about the y-axis. The result from all three modules is a continuous, positive form-fit surface. With moderate tensile loading of the second or third module in the x-direction, this can be compensated by the first module.

A continuous surface, resistant to loading in the x-direction, is therefore the result.

Example 6 (V-shape with Step)

The module according to the invention is made of wood and is 1.5 cm thick (in the y-direction). The maximum extent in the x-direction is 30 m. The maximum extent in the z-direction is 30 m. The module is V-shaped and has additional steps. It has only horizontal or vertical side surfaces that are orthogonal to each other. It is mirror-symmetric with reference to the x/z-plane.

The module consists in principle of five adjacent rectangles in which two of these have the same area in the x/z-plane. Two of the rectangles are squares with a side length of 6 cm. Two rectangles have half the area of the squares but the same edge length on one side. The fifth rectangle has twice the area of the square and also the same edge length of 6 cm. The same long edge is oriented in the z-direction; the rectangles are each shifted by half an edge length in the z-direction according to the following pattern: square—high—small rectangle—high—large rectangle—down—small rectangle—down—square.

In the following, the module is described when being viewed from the front. The front profile is constant in the y-direction. The edge lengths of the surfaces of the module in the counterclockwise direction are listed in the following, starting with the lower left corner of the module. The angle information is in brackets, starting from the end point of the previous edge corresponding to the normal degree distribution of a unit circle in 360° in the counterclockwise direction (the horizontals in the positive x-direction therefore correspond to 0°): UALE=6 cm (0°); ELI=3 cm (90°); MSI=3 cm (0°); ZLI=3 cm (90°); SI=12 cm (0°); ZLI=3 cm (270°); MSI=3 cm (0°); ELI=3 cm (270°); UARE=6 cm (0°); LAE=6 cm (90°); OARA=6 cm (180°); ELAA=3 cm (90°); MSA=3 cm (180°); ZLAA=3 cm (90°); SA=12 cm (180°); ZLAA=3 cm (270°); MSA=3 cm (180°); ELAA=3 cm (270°); OALA=6 cm (180°); IAE=6 cm (270°).

In a variant made of concrete, all lengths and thicknesses must be multiplied by a factor of 5.

This results in a V-shaped module with step which accords with the invention.

A second module can be so set on the first module, offset by a half module length (i.e. 15 cm) and rotated by 180° about the y-axis, that a positive form-fit between the two modules forms a continuous surface. A third module can now also be set onto the first, also offset by a half module length and rotated by 180°. The result from all three modules is a continuous, positive form-fit surface. With moderate tensile loading of the second or third module in the x-direction, this can be compensated by the first module.

A continuous surface, resistant to loading in the x-direction, is therefore the result.

The modification of the horizontal surfaces with sinusoidal waveform can be implemented in a manner similar to that of Example 3. The vertical side surfaces can be provided with a mortise-tenon system similar to that in Example 4.

A continuous surface, resistant to loading in the x-direction, is therefore the result.

Example 7 (V-shape with Flattened Step)

The module according to the invention is made of wood and is 1.5 cm thick (in the y-direction). The maximum extent in the x-direction is 30 m. The maximum extent in the z-direction is 12 cm. The module is V-shaped and has additional steps. It has only horizontal or vertical or however side surfaces that are at 45° to each other. It is mirror-symmetric with reference to the x/z-plane.

It is essentially based on the module in Example 6 wherein the additional steps, i.e. the horizontal, middle superior inner surfaces that are normally formed and the middle superior outer surfaces are replaced by sloping surfaces at a 45° angle, which also affects the lengths of the first and second lateral surfaces (ELI, ZLI, ELAA, ZLAA).

In the following, the module is described when being viewed from the front. The front profile is constant in the y-direction. The edge lengths of the surfaces of the module in the counterclockwise direction are listed in the following, starting with the lower left corner of the module. The angle information is in brackets, starting from the end point of the previous edge corresponding to the normal degree distribution of a unit circle in 360° in the counterclockwise direction (the horizontals in the positive x-direction therefore correspond to 0°): UALE=6 cm (0°); ELI=1.5 cm (90°); MSI=4.24 cm (45°); ZLI=1.5 cm (90°); SI=12 cm (0°); ZLI=1.5 cm (270°); MSI=4.24 cm (3150); ELI=1.5 cm (270°); UARE=6 cm (0°); LAE=6 cm (90°); OARA=6 cm (180°); ELAA=1.5 cm (90°); MSA=4.24 cm (135°); ZLAA=1.5 cm (90°); SA=12 cm (180°); ZLAA=1.5 cm (270°); MSA=4.24 cm (225°); ELAA=1.5 cm (270°); OALA=6 cm (180°); IAE=6 cm (270°).

In a variant made of concrete, all lengths and thicknesses must be multiplied by a factor of 5.

This results in a V-shaped module with flattened step which accords with the invention.

The modification of the horizontal surfaces with sinusoidal waveform can be implemented in a manner similar to that of Example 3. The vertical side surfaces can be provided with a mortise-tenon system similar to that in Example 6.

Example 8 (W-shape with More than One Step)

The module according to the invention is made of wood and is 1.5 cm thick (in the y-direction). The maximum extent in the x-direction is 30 m. The maximum extent in the z-direction is 12 cm. The module is V-shaped and also has several additional steps as well as an elevation in the middle of a recess (the shape is similar to an inverted "W"). It has only horizontal or vertical side surfaces that are orthogonal to each other. It is mirror-symmetric with reference to the xlz-plane.

In the following, the module is described when being viewed from the front. The front profile is constant in the y-direction. The edge lengths of the surfaces of the module in the counterclockwise direction are listed in the following, starting with the lower left corner of the module. The angle information is in brackets, starting from the end point of the previous edge corresponding to the normal degree distribution of a unit circle in 360° in the counterclockwise direction (the horizontals in the positive x-direction therefore correspond to 0°). For reasons of clarity, the exact names of the surfaces are dispensed with here. It is however shown whether the surface of the module is located at the right (r), left (1), top (o) or bottom (u): u=4 cm (0°); r=2 cm (90°); u=1 cm (0°); r=1 cm (90°); u=3 cm (0°); r=1 cm (90°); u=1 cm (0°); r=2 cm (90°); u=4 cm (0°); l=2 cm (270°); u=2 cm (0°); r=2 cm (90°); u=4 cm (0°); l=2 cm (270°); u=1 cm (0°); 1=1 cm (270°); u=3 cm (0°); I=1 cm (270°); u=1 cm (0°); l=2 cm (270°); u=4 cm (0°); r=2 cm (90°); u=1 cm (0°); r=6 cm (90°); o=1 cm (180°); r=2 cm (90°); o=4 cm (180°); r=2 cm (90°); o=1 cm (180°); r=1 cm (90°); o=3 cm (180°); r=1 cm (90°); o=1 cm (180°); r=2 cm (90°); o=4 cm (180°); 1=2 cm (270°); o=2 cm (180°); r=2 cm (90°); o=4 cm (180°); l=2 cm (270°); o=1 cm (180°); I=1 cm (270°); o=3 cm (180°); 1=1 cm (270°); o=1 cm (180°); I=2 cm (270°); o=4 cm (180°); r=2 cm (90°); o=1 cm (180°); l=6 cm (270°); u=1 cm (0°); I=2 cm (270°).

In a variant made of concrete, all lengths and thicknesses must be multiplied by a factor of 5.

The modification of the horizontal surfaces with sinusoidal waveform can be implemented in a manner similar to that of Example 3. The vertical side surfaces can be provided with a mortise-tenon system similar to that in Example 4.

A special mortise-tenon system can also be used, as already described, that has no symmetry in the y-direction. The W-shape, especially, can be formed with double slopes at the lateral surfaces.

The invention claimed is:

1. A stackable surface module for the reversible construction and dismantling of a wall-surface or shell-surface, the module comprising:

a front side having a side projection area;

a rear side having a side projection area;

a top side a bottom side;

lateral sides;

at least two lower extensions in the z-direction;

at least one lower recess limited by the least two lower extensions in the x-direction, and being in the z-direction lying in the x-direction between the at least two lower extensions, and interlocking points overlaid on a surface of a perimeter of the module that are interrupted at at least at one point along the entire perimeter, the module having a three-dimensional shape, and extending over a space in the x-, y-, and z-directions, the module being configured to be stacked on an additional module in the z-direction, the front and rear sides of the module each point in the y-direction, the top and bottom sides each point in the z-direction and the lateral sides point in the x-direction, the side projection area of the front side or the rear side onto the x/z-plane is greater in each case than the side projection area of the top or bottom side onto the x/y-plane, the side projection area of the front side or the rear side onto the x/z-plane is greater in each case than the side projection area of the lateral sides onto the y/z-plane, the module being configured to be joined with a multitude of modules so as to form, in an assembled state, a contiguous wall or shell surface, which extends continuously in the x- and z-directions, the module being configured to be stacked in the z-direction with the multitude of modules, and configured to be offset in the x-direction and rotated through 180° about the x- and/or y-axes, so as to be stacked in the z-direction, an interlocking point of the interlocking points is configured to block movement of adjacent modules in the wall in one of the two y-directions, the interlocking points including at least one interlocking point pair with positive and negative interlocking points, the positive interlocking points configured to lock in the positive y-direction and the negative interlocking points configured to lock in the negative y-direction so that the at least one interlocking point pair is capable of blocking both y-directions in the wall.

2. The stackable surface module according to claim 1, wherein the at least two extensions are configured to fit into a recess of a module of a next wall layer above or below in the z-direction.

3. The stackable module according to claim 1, wherein a thickness of the module varies in the z-direction.

4. The stackable surface module according to claim 1, wherein a depth of the at least one lower recess lies between 25% and 75% of a total module height in the z-direction.

5. The stackable surface module according to claim 1, wherein a maximum module thickness in the y-direction is less than a maximum depth of the at least one lower recess.

6. The stackable surface module according to claim 1, wherein, in a projection on to the x/z-plane, a total area of two extensions is equal to a total area of the at least one lower recess formed in the x-direction.

7. The stackable surface module according to claim 1,further comprising at least two upper extensions in the z-direction and at least one downward-reaching recess in the z-direction confined in the x-direction by the at least two upper extensions, the at least one downward-reaching recess lying in the x-direction between the at least two extensions.

8. The stackable surface module according to claim 1, further comprising at least two upper cutouts in the z-direction and at least one upward-reaching upper bulge in the z-direction, the at least one upward-reaching upper bulge confined in the x-direction by the at least two upper cutouts and lying in the x-direction between the at least two upper cutouts.

9. The stackable surface module according to claim 1, wherein the module has no cavity in the x/y-plane.

10. The stackable surface module according to claim 1, wherein every interlocking point includes a surface modulation with at least one interlocking protuberance from the surface of the perimeter and a complementary hollow to the at least one interlocking protuberance so that every interlocking point is capable of forming an interlocking point structure with surface modulations on adjacent modules in the assembled state of the wall surface, and a curve of the surface modulation at every interlocking point in the y-direction is not continuously parallel to the y-direction, so that every interlocking point is capable of forming the interlocking point in a positive form-fit lock in at least one y-direction normal to the wall or shell surface.

11. The stackable surface module according to claim 1, wherein the interlocking point of the interlocking points comprises at least one locking surface on a y-axis position which lies between 40% and 60% of a maximum y-axis depth of the module.

12. The stackable surface module according to claim 1, wherein the interlocking point of the interlocking points is 5 to 20% of the module in the x-direction.

13. The stackable surface module according to claim 1, wherein the module is curved in one or two directions.

14. The stackable surface module according to claim 1, wherein the interlocking point of the interlocking point includes a protuberance in the z-direction that is at least 10% of the module in the z-direction.

15. The stackable surface module according to claim 1, wherein the module is configured to form earthquake-resistant walls, a bridge, a cupola, a site fence, a noise protection wall, an upwind power station, heat exchangers, a coastal protection wall or a toy house.

* * * * *